US007392983B2

(12) United States Patent
Kodama et al.

(10) Patent No.: US 7,392,983 B2
(45) Date of Patent: Jul. 1, 2008

(54) SHEET POST-PROCESSING UNIT AND IMAGE FORMING APPARATUS

(75) Inventors: Takehiko Kodama, Toride (JP); Naoto Saeki, Abiko (JP); Akihiko Sugiyama, Abiko (JP); Naoyasu Funada, Moriya (JP); Masato Nonaka, Moriya (JP)

(73) Assignee: Canon Finetech Inc., Ibaraki-ken (JP)

( * ) Notice: Subject to any disclaimer, the term of this patent is extended or adjusted under 35 U.S.C. 154(b) by 269 days.

(21) Appl. No.: 10/940,758

(22) Filed: Sep. 15, 2004

(65) Prior Publication Data

US 2005/0121848 A1 Jun. 9, 2005

(30) Foreign Application Priority Data

| | | |
|---|---|---|
| Sep. 18, 2003 | (JP) | 2003-325702 |
| Oct. 31, 2003 | (JP) | 2003-372918 |
| Oct. 31, 2003 | (JP) | 2003-372919 |
| Oct. 31, 2003 | (JP) | 2003-372920 |
| Oct. 31, 2003 | (JP) | 2003-372922 |

(51) Int. Cl.
*B65G 37/04* (2006.01)

(52) U.S. Cl. ..... 271/249; 270/58.01; 270/58.08; 270/58.12; 270/58.17; 270/58.27; 271/228; 271/250

(58) Field of Classification Search ..... 270/58.01, 270/58.08, 58.12, 58.17, 58.27; 271/228, 271/249, 250
See application file for complete search history.

(56) References Cited

U.S. PATENT DOCUMENTS

| | | | | |
|---|---|---|---|---|
| 5,084,736 A | | 1/1992 | Suzuki et al. | 399/303 |
| 5,168,290 A | | 12/1992 | Tanaka et al. | 346/134 |
| 5,239,347 A | | 8/1993 | Onodera et al. | 399/304 |
| 5,273,274 A | * | 12/1993 | Thomson et al. | 271/228 |
| 5,321,486 A | | 6/1994 | Nanbu et al. | 399/14 |
| 5,335,904 A | * | 8/1994 | Ryuzaki | 271/272 |
| 5,543,908 A | | 8/1996 | Suzuki | 399/398 |
| 5,555,082 A | | 9/1996 | Tanaka et al. | 399/397 |
| 5,590,871 A | | 1/1997 | Okabe et al. | 270/58.27 |
| 5,622,359 A | | 4/1997 | Kawano et al. | 270/58.12 |
| 5,676,363 A | | 10/1997 | Kishida et al. | 271/10.01 |

(Continued)

FOREIGN PATENT DOCUMENTS

| | | |
|---|---|---|
| JP | 7-257811 | 10/1995 |
| JP | 11-322160 | 11/1999 |
| JP | 2002-37512 | 2/2002 |
| JP | 2002-274734 | 9/2002 |
| JP | 2002-284425 | 10/2002 |
| JP | 2003-81517 | 3/2003 |

OTHER PUBLICATIONS

Official Action, dated May 17, 2007, in U.S. Appl. No. 11/103,589.

*Primary Examiner*—Gene O. Crawford
*Assistant Examiner*—Leslie A Nicholson, III
(74) *Attorney, Agent, or Firm*—Fitzpatrick, Cella, Harper & Scinto

(57) ABSTRACT

There is provided a sheet post-processing unit and image forming unit, which is capable of stably conveying sheets discharged one after another to a tray to form a bundle of sheets and to staple the bundle. A sheet conveying means is provided for selectively conveying the sheet to be discharged in the downstream and upstream directions of the sheet discharging direction, as well as moving the sheet in a direction intersecting the sheet conveying direction, and which is capable of moving up and down to be contactable with, and detachable from, the sheet.

26 Claims, 30 Drawing Sheets

U.S. PATENT DOCUMENTS

| | | | | |
|---|---|---|---|---|
| 5,738,453 | A | 4/1998 | Tsuburaya et al. | 400/624 |
| 5,938,186 | A | 8/1999 | Sato et al. | 270/58.11 |
| 5,951,000 | A | 9/1999 | Sato et al. | 270/58.11 |
| 6,168,154 | B1 * | 1/2001 | Asahara et al. | 271/245 |
| 6,273,418 | B1 * | 8/2001 | Fujikura et al. | 271/228 |
| 6,357,736 | B1 | 3/2002 | Kubota et al. | 270/58.08 |
| 6,427,997 | B1 | 8/2002 | Hirota et al. | 270/58.12 |
| 6,473,196 | B2 | 10/2002 | Usami et al. | 358/1.18 |
| 6,561,503 | B1 * | 5/2003 | Ogata et al. | 270/58.12 |
| 6,601,846 | B2 * | 8/2003 | Saito et al. | 271/226 |
| 6,705,603 | B1 * | 3/2004 | Kirino et al. | 270/12 |
| 6,819,906 | B1 | 11/2004 | Herrmann et al. | 399/368 |
| 7,192,020 | B2 | 3/2007 | Hayashi et al. | 270/58.11 |
| 2003/0219294 | A1 | 11/2003 | Yoshimura et al. | 399/408 |
| 2004/0173960 | A1 | 9/2004 | Oikawa et al. | 271/208 |
| 2004/0181308 | A1 | 9/2004 | Hayashi et al. | 700/223 |
| 2004/0188911 | A1 | 9/2004 | McNamara et al. | 270/58.08 |
| 2005/0121848 | A1 | 6/2005 | Kodama et al. | 270/58.12 |

* cited by examiner

SHEET POST-PROCESSING UNIT AND IMAGE FORMING APPARATUS

BACKGROUND OF THE INVENTION

1. Field of the Invention

The present invention relates to a sheet post-processing unit and an image forming apparatus, such as a copying machine, a laser printer, a facsimile and a multifunction machine of those machines, for carrying out post-processing jobs such as stacking, aligning and binding on sheets discharged from the image forming apparatus.

2. Description of Related Art

Hitherto, there have been known a sheet post-processing unit, and an image forming apparatus equipped therewith, for carrying out post-processing jobs such as a stacking job of stacking a plurality of discharged sheets, an aligning jobs of aligning the plurality of stacked sheets and a binding (stapling) job of binding the plurality of aligned sheets as disclosed in Japanese Patent Laid-Open Nos. 2002-274734 and 2002-37512 for example. As shown in FIG. 30, this unit binds a bundle of sheets after discharging the sheet by flying to a stapling tray 902 by means of sheet discharging rollers 901*a* and 901*b*, moving the sheet in the direction along the sheet conveying direction to align the both widthwise edges of the sheet by width aligning members 903*a* and 903*b* and others, and aligning the edges of the sheet in the conveying direction.

In order to do that, the sheet post-processing unit is equipped with an elastic member called a paddle 903 and an aligning belt 904 that rotates in synchronism with discharging rollers 901*a* and 901*b* for discharging sheets onto the stapling tray 902. The unit is arranged to align the sheet in the conveying direction by pulling back the sheet by the paddle 903 to a nip point between the aligning belt 904 and the stapling tray 902 and by hitting the sheet against a hitting alignment member 905 by frictional force of the aligning belt 904. It is noted that although the alignment belt 904 is shown to have a small diameter in FIG. 30 to simplify the drawing, it actually has a diameter larger than that shown in FIG. 30 and is disposed at the position closer to the stapling tray 902.

The sheet which has been discharged onto the stapling tray 902 and whose edge in the sheet conveying direction has been aligned by hitting against the hitting alignment member 905 is subjected to another operation of aligning the widthwise edges of the sheet which is carried out by sandwiching the sheet by width aligning members 903*a* and 903*b* in the direction orthogonal to the sheet conveying direction.

Accordingly, since the prior art sheet post-processing unit aligns the widthwise edge of the sheet by moving the width aligning members 903*a* and 903*b* movable in the sheet width direction as means for aligning the sheet in the width direction, it requires a wide stapling tray. Still more, assuming that the sheet extends/contracts due to temperature, humidity and others and that the sheet size subtly changes due to that, the unit is arranged so as to be able to absorb such changes by a certain degree by providing springs for example in the width aligning members 903*a* and 903*b*, it is unable to absorb the change exceeding the flexibility of the spring, thus possibly causing a buckling of the sheet and of causing a disturbance in the alignment.

Still more, in aligning the sheet in the conveying direction by hitting the edge of the sheet against the hitting alignment member 905 by the frictional force of the aligning belt 904, the prior art sheet post-processing unit has a possibility of causing a disturbance in the aligned bundle of sheets due to a subtle instability of the aligning belt 904, which occurs in rotating the aligning belt 904.

Further, since the prior art sheet post-processing unit utilizes the frictional force obtained in rotating the paddle as means for aligning the sheet in the sheet conveying direction, there is a possibility of causing buckling when the sheet hits against the hitting section because the deflection of the paddle increases with the increase of number of stacked sheets, thus increasing the contact pressure of the paddle against the sheet.

Still more, because the discharging rollers 901*a* and 901*b* discharge the sheet as if they kick (fly) out the sheet in discharging to the stapling tray 902, the sheet is not stably conveyed to the hitting section in such a case when the sheet is disorderly discharged or when a type of sheet that will not stably fall is conveyed.

Since the sheet discharged to the stapling tray 902 is just returned and stacked by the paddle 903 and the aligning belt 904, it is necessary to adjust the size and angle of installation of the stapling tray to prevent the sheet from being dragged by the succeeding sheet and to stably return the sheet.

The prior unit also requires many independent devices such as the mechanisms for aligning the sheet in the conveying and width directions as described above to carrying out the above-mentioned operations, thus increasing the complexity and size thereof.

It is therefore an object of the invention to provide a sheet post-processing unit and an image forming apparatus capable of stably conveying sheets and of lessening disturbances in aligning the sheets with a simple arrangement having a small processing tray that is less influenced by the angle thereof and others.

BRIEF SUMMARY OF THE INVENTION

According to the invention, a sheet post-processing unit is provided with sheet stacking means (a tray for example) for stacking sheets sequentially discharged one after another; sheet conveying means (rollers for example) for conveying the sheets to be discharged to the sheet stacking means; intersectional moving means (a reciprocal driving unit composed of a reciprocating members such as a rack and a pinion and a motor for driving the pinion for example) for moving the sheet conveying means in the direction intersecting with the sheet discharging direction; and regulating means (regulating members for example) for aligning the edges of the sheets.

More specifically, the sheet post-processing unit is provided with sheet stacking means (a tray for example) for stacking sheets sequentially discharged one after another; sheet conveying means (rollers for example), capable of moving up and down and contactable with the sheet, for selectively conveying the discharged sheet in the downstream and upstream directions of the sheet discharging direction; a regulating member (a trailing edge stopper for example) for aligning the sheet stacked on the sheet stacking means by hitting against the upstream edge of the sheet; intersectional moving means (a reciprocal driving device for example) for moving the sheet conveying means in the direction intersecting with the sheet conveying direction; and an intersectional regulating member (a positioning wall for example) for aligning the sheet by hitting against the edge of the sheet on the side intersecting with the sheet conveying direction.

Preferably, the sheets whose upstream and intersecting side edges are regulated and aligned are then processed in a predetermined manner by the post-processing means such as stapling means and punching means for example. It is noted that the post-processing unit described above encompasses not only the units for processing by the processing means described above but also units for aligning the sheets by the regulating members described above. That is, the post-processing unit means to be a unit for aligning or stapling the sheets additionally on which such processes as image forming have been carried out by a printer, a copying machine and others.

Preferably, the sheet conveying means aligns sheets by conveying the uppermost sheet stacked on the sheet stacking means and by hitting the uppermost sheet against the regulating means and the intersectional regulating means.

Preferably, the sheet post-processing unit is also provided with a control section for controlling an extent of conveyance of the sheet conveying means so that the respective extent of conveyance of the uppermost sheet conveyed by the sheet conveying means that aligns the sheet by hitting the edge thereof against the regulating means is larger than a distance to the regulating means that corresponds to the edge of the hitting uppermost sheet and so that the sheet conveying means slides on the uppermost sheet after hitting the uppermost sheet against the regulating means.

Preferably, the sheet post-processing unit is also provided with clamping means (a sheet clamping member for example) for clamping a sheet to prevent the sheet from following a moving succeeding sheet when the succeeding sheet is stacked on the preceding sheet stacked on the sheet stacking means and is conveyed or transferred.

Preferably, the sheet post-processing unit is provided with second sheet stacking means (a stack tray for example), disposed in the vicinity of the sheet stacking means and movable in the vertical direction, for stacking the sheets; and transfer means (a sheet bundle discharging member for example) for clamping and transferring the sheets stacked on the sheet stacking means to the second sheet stacking means.

Preferably, the sheet conveying means is composed of rollers and the outer periphery of the roller is made of rubber or an elastic member close to rubber such as a foamy member.

In order to attain the above-mentioned object, an image forming apparatus of the invention comprises image forming means for forming images and the sheet post-processing unit described above for post-processing sheets on which images have been formed by the image forming means.

More specifically, an image forming apparatus of the invention comprises image forming means for forming images; sheet stacking means (a post-processing tray for example) for sequentially stacking the sheets on which images have been formed by the image forming means; sheet conveying means (rollers for example) for conveying the sheets to be stacked on the sheet stacking means; intersectional moving means for moving the sheet conveying means in the direction intersecting with the sheet conveying direction; regulating means for regulating and aligning the edges of the sheets; and a control section for controlling the sheet conveying means and the intersectional moving means.

Preferably, the sheet post-processing unit or the image forming apparatus of the invention further comprises a clamping member (sheet clamping member for example) for clamping the sheet to prevent it from following a moving succeeding sheet when the succeeding sheet is stacked on the preceding sheet stacked on the sheet stacking means and is conveyed by the sheet conveying means; second sheet stacking means (a stack tray for example), disposed in the vicinity of the sheet stacking means and movable in the vertical direction, for stacking the sheets; transfer means (a sheet bundle discharging member for example) for clamping and transferring the sheet stacked on the sheet stacking means (a post-processing tray for example) to the second sheet stacking means; and the control section for moving the second sheet stacking means so that the height of the upper face of the sheet transferred to the second sheet stacking means becomes almost equal with the height of the stacking face of the sheet stacking means after transferring the sheet to the second sheet stacking means by controlling the transfer means.

Preferably, the sheet post-processing unit or the image forming apparatus of the invention is also provided with vertical moving means (an actuator for example) for moving up and down the sheet conveying means with respect to the sheet stacking means.

Since the inventive sheet post-processing unit receives, conveys and aligns the sheet by the sheet conveying means when the sheets are discharged to the sheet stacking means one after another, the sheets are discharged without causing a jump and are conveyed and aligned stably with less disturbance.

Still more, since the sheet conveying means directly conveys the discharged sheet and aligns the sheet by hitting the trailing edge of the sheet against the trailing edge stopper, the inventive sheet post-processing unit is capable of aligning the sheets steadily. Further, since the sheet conveying means is moved in the direction intersecting with the sheet discharging direction to align the sheet by hitting the side edge of the sheet against the positioning wall, the sheet may be steadily aligned even by a small post-processing tray and the structure of the unit may be simplified without providing another device for aligning the side edge of the sheet.

Since the sheet conveying means of the inventive sheet post-processing unit conveys and aligns the uppermost sheet among the sheets stacked on the sheet stacking means by its own weight and frictional force, a constant load is always applied to the uppermost sheet and differing from the case of prior art of conveying and aligning sheets by rotating the paddle, the sheet may be conveyed and aligned stably without being influenced by a number of stacked sheets, temperature, humidity and others.

Further, according to the inventive sheet post-processing unit, the extent of conveyance of the sheet conveyed by the sheet conveying means is set to be longer than a distance from the edges of the hitting sheet to the trailing edge stopper and to the positioning wall in aligning the sheet by hitting the edges of the sheet against the trailing edge stopper and against the positioning wall and the sheet conveying means slides on the uppermost sheet while adjusting obliqueness of the sheet after hitting the trailing edge of the sheet, so that the inventive sheet post-processing unit can steadily align the sheet without applying compulsory force to the sheet and while absorbing such effects as changes of size of the sheet caused by the change of temperature and humidity.

Since the inventive sheet post-processing unit is provided with the clamping means for clamping the sheet stacked on the sheet stacking means, it is possible to prevent the preceding sheet from following the succeeding sheet when the succeeding sheet is conveyed to the sheet stacking means. Further, it allows a plurality of sheets to be aligned effectively with the simple structure regardless of the shape and installation angle of the post-processing tray.

Still more, since the inventive sheet post-processing unit is provided with the second sheet stacking means which is capable of moving in the vertical direction in the vicinity of the sheet stacking means and with the transfer means for transferring the sheet to the second sheet stacking means while clamping the sheet stacked on the sheet stacking means, the post-processing tray for processing the sheet may be downsized. Further, since it allows bundles of post-processed sheets to be conveyed to the second sheet stacking means one after another, a large number of sheets may be efficiently processed.

Since the sheet conveying means in the inventive sheet post-processing unit is composed of rollers and its outer periphery is made of rubber or elastic member close to rubber such as foamy member, the optimum frictional force and conveying force for conveying and aligning sheets may be obtained. Still more, since no load more than required is applied to the sheet, the sheet may be stably conveyed and aligned without damage and without being influenced by the condition and type of the sheet.

In order to attained the above-mentioned object, the inventive image forming apparatus is equipped with image forming means for forming images and any one of sheet post-processing units described above for post-processing the sheet on which an image is formed, so that it is capable of efficiently, stably and reliably aligning and post-processing the sheet conveyed to the sheet post-processing unit in linkage with the sheet post-processing unit. Accordingly, it is possible to provide the image forming apparatus equipped with the sheet post-processing unit with the simple structure.

In order to attain the above-mentioned object, the inventive image forming apparatus is provided with image forming apparatus for forming images; sheet stacking means for sequentially stacking sheets on which images have been formed; sheet conveying means for conveying the stacked sheet; control means for controlling the sheet conveying means so as to convey the sheet to align the trailing edge of the sheet and to move in the direction intersecting with the sheet discharging direction to align the side edge of the sheet, so that it is possible to provide the image forming apparatus which carries out such sheet post-processing as aligning of the sheet steadily with the simple structure.

In order to attain the above-mentioned object, the sheet post-processing unit or the image forming apparatus of the invention is also provided with clamping means for clamping a preceding sheet to prevent it from following a moving succeeding sheet when the succeeding sheet is stacked on the preceding sheet stacked on the sheet stacking means and is conveyed by the sheet conveying means; second sheet stacking means, disposed in the vicinity of the sheet stacking means and movable in the vertical direction, for stacking the sheets; transfer means for clamping and transferring the sheets stacked on the sheet stacking means to the second sheet stacking means; and a control section for moving the second sheet stacking means so that the height of the upper face of the sheet transferred to the second sheet stacking means becomes almost equal to the height of a stacking face of the sheet stacking means after transferring the sheet to the second sheet stacking means by controlling the transfer means. Accordingly, bundles of post-processed sheets may be conveyed to the stack tray one after another by controlling the post-processing tray for processing the sheet in linkage with the stack tray for finally stacking the post-processed sheets. The post-processing tray may be downsized and a large volume of sheets may be efficiently processed by controlling the height of the upper face of the sheet conveyed to and stacked on the stack tray to be almost equal to the height of the sheet stacking face of the sheet post-processing tray.

Still more, in order to attain the above-mentioned object, the sheet post-processing unit or image forming apparatus of the invention is structured so that the sheet conveying means is separated from the sheet stacking means when no sheet is conveyed or aligned by the sheet conveying means, so that no unnecessary load is applied to the sheet and the sheet may be conveyed and aligned stably without damage or without being influenced by a number of stacked sheets, temperature, humidity and others.

Additional objects and advantages of the invention will be apparent from the following detailed description of preferred embodiments thereof, which are best understood with reference to the accompanying drawings.

BRIEF DESCRIPTION OF THE DRAWINGS

FIGS. 3A and 3B are block diagrams showing the connection among a control section, sensors, motors and others of the inventive sheet post-processing unit, wherein FIG. 3A is an overall block diagram and FIG. 3B is diagram showing the contents of work data stored in a RAM.

FIGS. 18A, 18B and 18C are schematic front views for explaining a sheet bundle discharging operation of the sheet post-processing unit, wherein FIG. 18A shows a state in which a bundle of sheets is discharged by the sheet bundle discharging member, FIG. 18B shows a state in which the sheet bundle trailing edge hitting member is in operation and FIG. 18C shows a state in which the pressing arm is in operation.

FIGS. 23A and 23B are schematic front views of another modification of the inventive sheet post-processing unit in which a curled sheet is aligned, wherein FIGS. 23A and 23B show different sheet conveying states.

FIGS. 24A and 24B are schematic front views of the other modification of the inventive sheet post-processing unit showing states in which the sheet is curled in the direction intersecting with the sheet conveying direction, wherein FIGS. 24A and 24B show different sheet conveying processes.

DETAILED DESCRIPTION OF THE INVENTION

Modes for carrying out a sheet post-processing unit and an image forming apparatus of the invention will be explained below with reference to the accompanying drawings.

Figure 1:
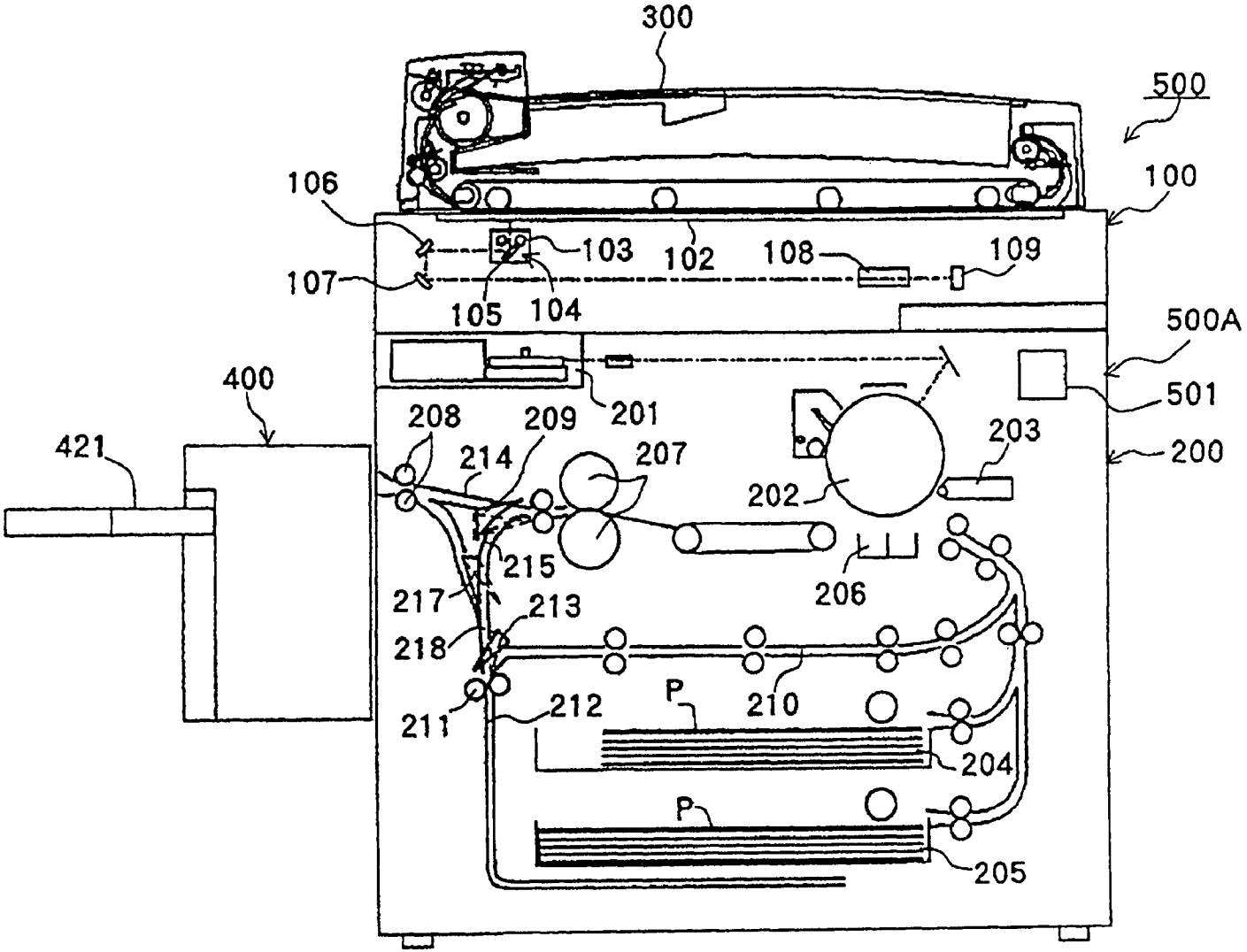
FIG. 1 is schematic front section view of a copying machine, which is an exemplary image forming apparatus, equipped with an inventive sheet post-processing unit by the main unit thereof.

FIG. 1 is a front section view schematically showing an internal structure of a copying machine which is an exemplary image forming apparatus equipped with the inventive sheet post-processing unit by the main unit thereof. It is noted that the image forming apparatus encompasses a copying machine, a facsimile, a printer, a multifunction machine of those machines and the like. Accordingly, the inventive sheet post-processing unit maybe attached not only to a copying machine, but also to the other image forming apparatuses such as a facsimile, a printer and a multifunction machine. The sheet post-processing unit may be also built into a main unit of the image forming apparatus. It is also conceivable to use the unit singularly by itself.

In FIG. 1, the image forming apparatus comprises the inventive sheet post-processing unit 400, a copying machine 500 and an automatic document feeder (referred to as an ADF hereinafter) 300 for automatically feeding documents.

The copying machine 500 is composed of a reader section 100, a printer section 200, the sheet post-processing unit 400 and others. The, ADF 300 for supplying documents one by one to a platen glass 102 is provided at the upper part of the copying machine 500. The sheet post-processing unit 400 for post-processing sheets discharged from a main unit 500A of the copying machine 500 is connected to the side of the main unit 500A. In FIG. 1, the reader section 100 transforms images of documents into image data. The printer section 200 has a plurality of types of sheet cassettes 204 and 205 in which a plurality of sheets is stacked and forms the image data on the sheet as a visual image upon receiving a printing command.

When the ADF 300 conveys a document to a predetermined position on the platen glass 102, the reader section 100 lights up a lamp 103 thereof and horizontally moves a scanner unit 104 so that the lamp 103 illuminates the document.

Reflection light from the document enters a CCD image sensor section 109 through mirrors 105, 106 and 107 as well as a lens 108. The reflection light of the document inputted to the CCD image sensor section 109 is subjected to electrical processing such as photoelectric conversion in the CCD image sensor section 109 to be digitized in a manner normally carried out. Its image signal is then inputted to the printer section 200.

The image signal inputted to the printer section 200 is modulated by an exposure control section 201 and is converted into an optical signal. It is then irradiated to a photoreceptor 202 for example as image forming means. An electrostatic latent image is formed on the photoreceptor 202 by the irradiated light and a developer 203 develops and visualizes the electrostatic latent image on the photoreceptor 202 as a toner image. Then, in time with the edge of the toner image, a sheet is conveyed from one of the sheet cassettes 204 and 205 so as to transfer the toner image to the sheet in a transfer section. A fixing section 207 fixes the transferred image to the sheet. A member 219 for switching the direction of conveying path conveys the sheet on which the image has been fixed through a path 214 to discharge to the outside of the main unit 500A of the copying machine 500 from a sheet discharging section 208. The sheet is then subjected to sorting, binding or the like corresponding to a sheet processing operation mode specified in advance through the sheet post-processing unit 400.

Next, steps for forming images read one after another on the both sides of one sheet will be explained.

The direction switching members 209 and 217 guide the sheet, on which the image has been fixed on one side thereof by the fixing section 207 as described above, to paths 215 and 218 and a direction switching member 213 successively guides it to a reversing path 212. When the direction switching member 213 switches the direction and the rotating direction of a roller 211 is reversed after when the trailing edge of the sheet has passed the direction switching member 213, the conveying direction of the sheet is reversed and the sheet is conveyed to a copied sheet stacking section 210. It stands by there once while keeping up the surface on which the image has been fixed. Next, when the ADF 300 prepares a next document on the platen glass 102, the reader section 100 reads an image of the document and a toner image is formed on the photoreceptor 202 after undergoing the exposure and developing processes in the printer section 200 similarly to the processes described above. Then, in time with the edge of the toner image, the sheet which has been waiting in the copied sheet stacking section 210 is conveyed to the transfer section 206 so that the image is transferred on the back of the sheet. The sheet is then fixed by the fixing section 207 and is discharged to the outside of the main unit 500A from the sheet discharging section 208 via the path 214 under the guidance of the direction switching member 209. Thus, the images of two documents may be formed on the surface and back of one sheet.

(Sheet Post-Processing Unit)

Figure 2:
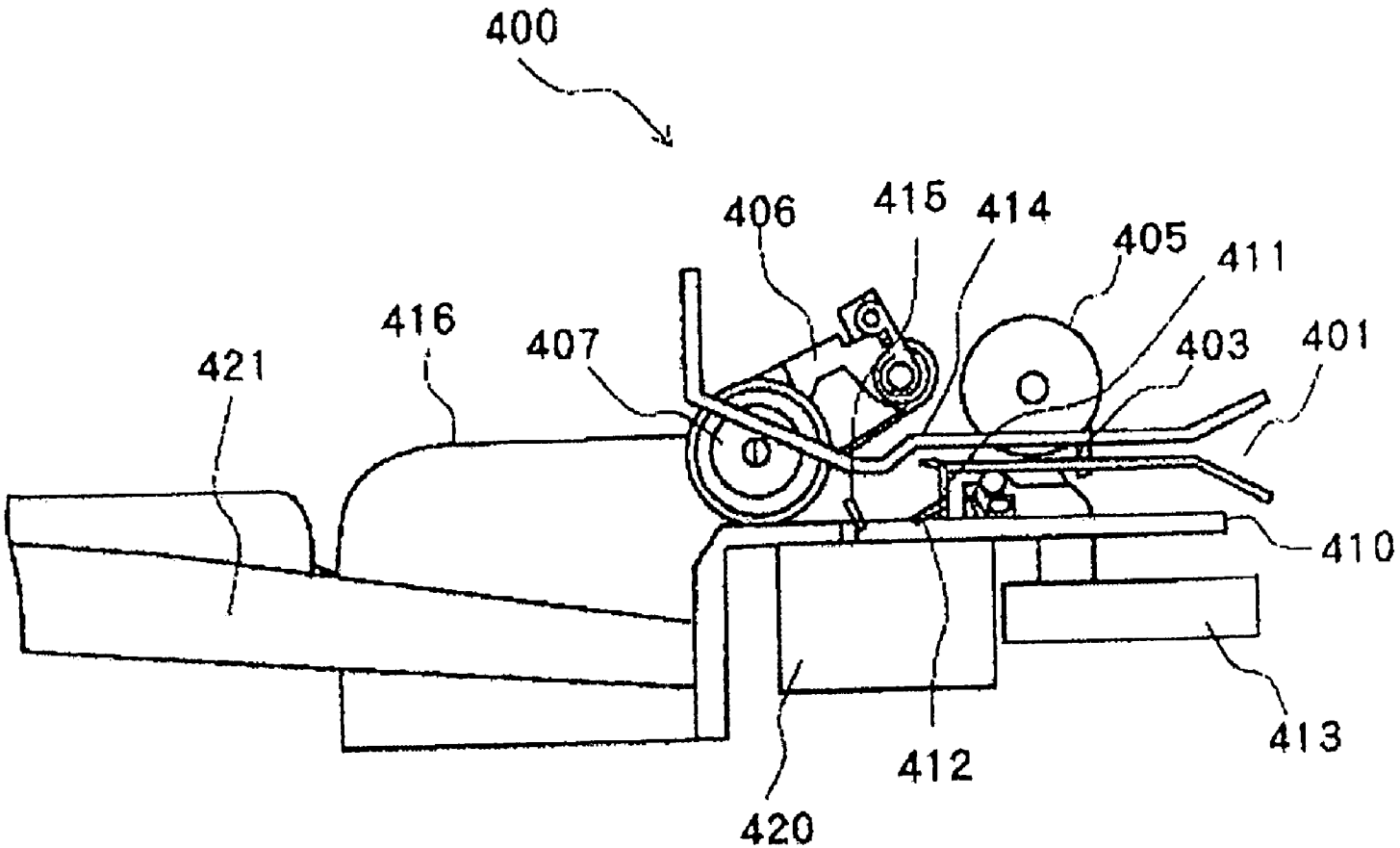
FIG. 2 is a schematic front view showing a structure of the sheet post-processing unit according to a preferred embodiment of the invention.

FIG. 2 is a schematic front section view of the sheet post-processing unit 400 and FIG. 3 is a block diagram showing connections of a control section of the sheet post-processing unit 400 with sensors, motors and others.

In addition to the sorting function for sorting sheets, the sheet post-processing unit 400 is provided with a stapling function executed by a stapler unit 420 for example.

The sheet post-processing unit 400 comprises a post-processing tray 410 for example as sheet stacking means for storing sheets discharged one after another from the main unit 500A of the copying machine 500, offset rollers 407 for example as sheet conveying means for receiving the sheets discharged from the main unit 500A of the copying machine 500 to align the sheets on the post-processing tray 410, a stack tray 421 for example as second stacking means for finally stacking a bundle of sheets formed on the post-processing tray 410, a CPU 111 for example as the control section for controlling the sheet post-processing unit 400 based on a control signal from a controller within the main unit 500A (see FIG. 1), sensors 403, 150, 160, 230 and 415, motors 431, 432, 430 and 135, solenoids 433 and 434 described later in detail, a stapler unit 420 for stapling a bundle of sheets, and others. The sheet post-processing unit 400 is arranged so as to form a bundle of sheets corresponding to a number of documents on-the post-processing tray 410 and to discharge it to the stack tray 421 per bundle of sheets. Note that it is possible to arrange so that the control is made by combining the controller 501 within the main unit 500A with the CPU 111 or vice versa.

Figure 5:
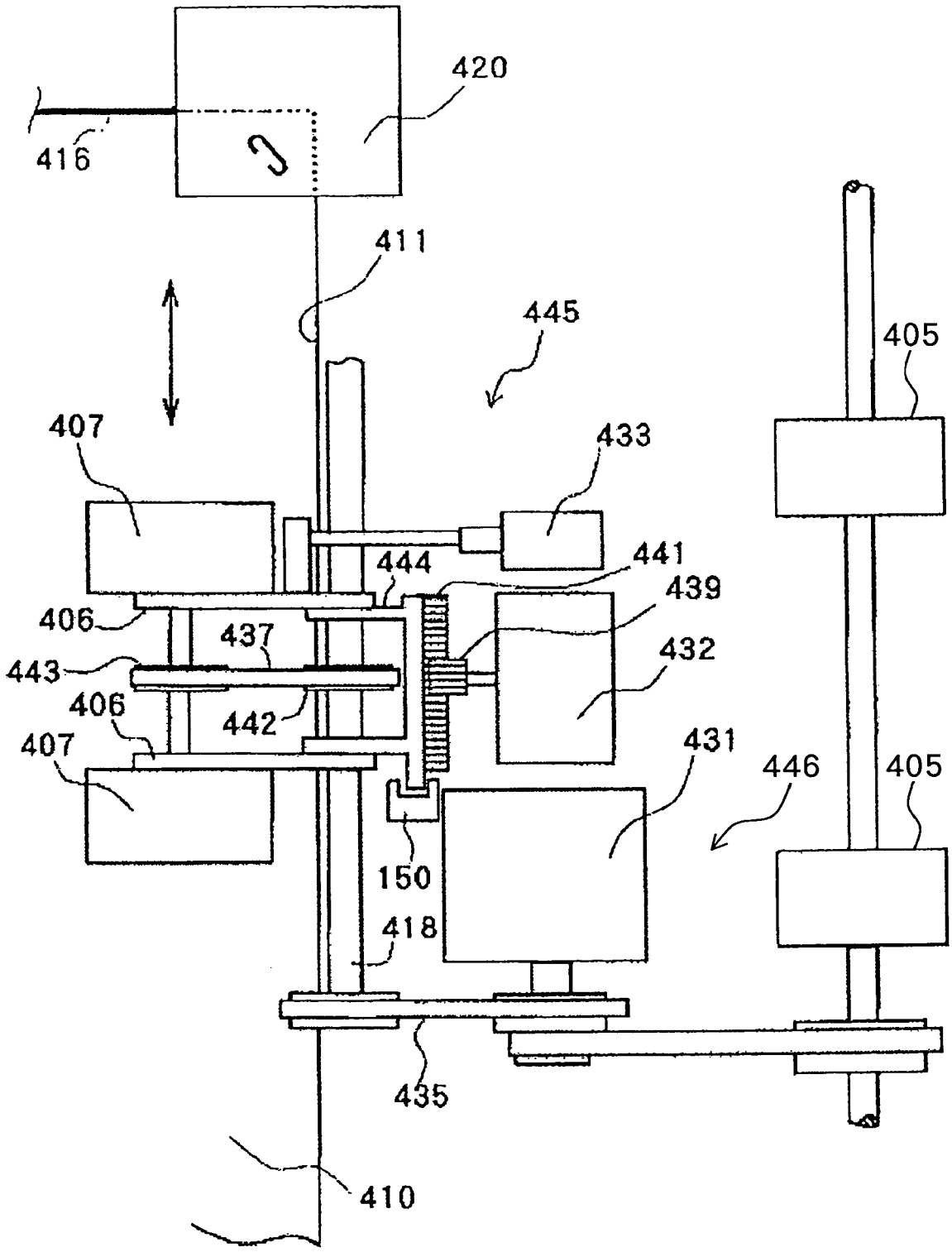
FIG. 5 is a schematic plan view showing a mechanism for driving the offset roller and the conveying roller of the inventive sheet post-processing unit.

It is also noted that the sheet conveying means composed of a conveyance motor 431, a belt 435, a square shaft 418, pulleys 442 and 443, a belt 437, offset roller arms 406, offset rollers 407 and others for example in FIG. 5 also constitutes a conveying-direction moving device 446 for example as conveying-direction moving means for selectively moving the sheet to the downstream and upstream sides of the sheet conveying direction.

An offset motor 432, a pinion 439, a rack 441, a rack supporting member 444, the square shaft 418, the offset roller arms 406, the offset rollers 407 and others also compose an intersectional moving device (reciprocal driving device) 445 for example as intersectional moving means for moving the offset rollers 407 in the direction intersecting with the sheet conveying direction to its offset home position and to a positioning wall 416 as a position for aligning the sheet.

Figure 3A:
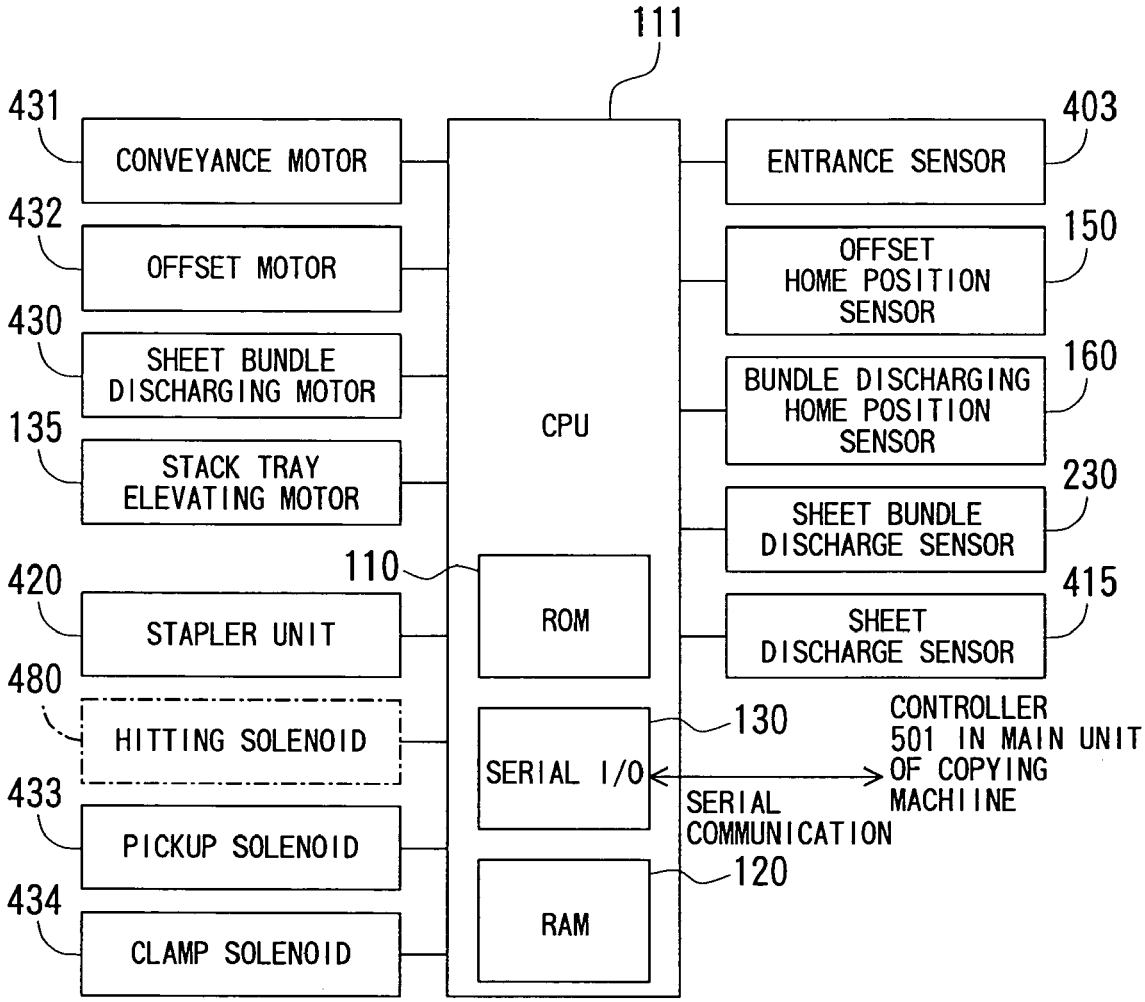
Figure 3B:
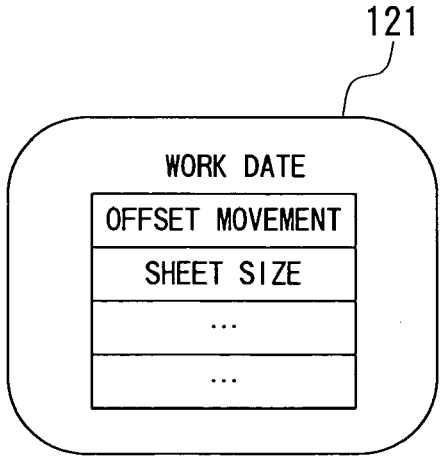
Figure 8:
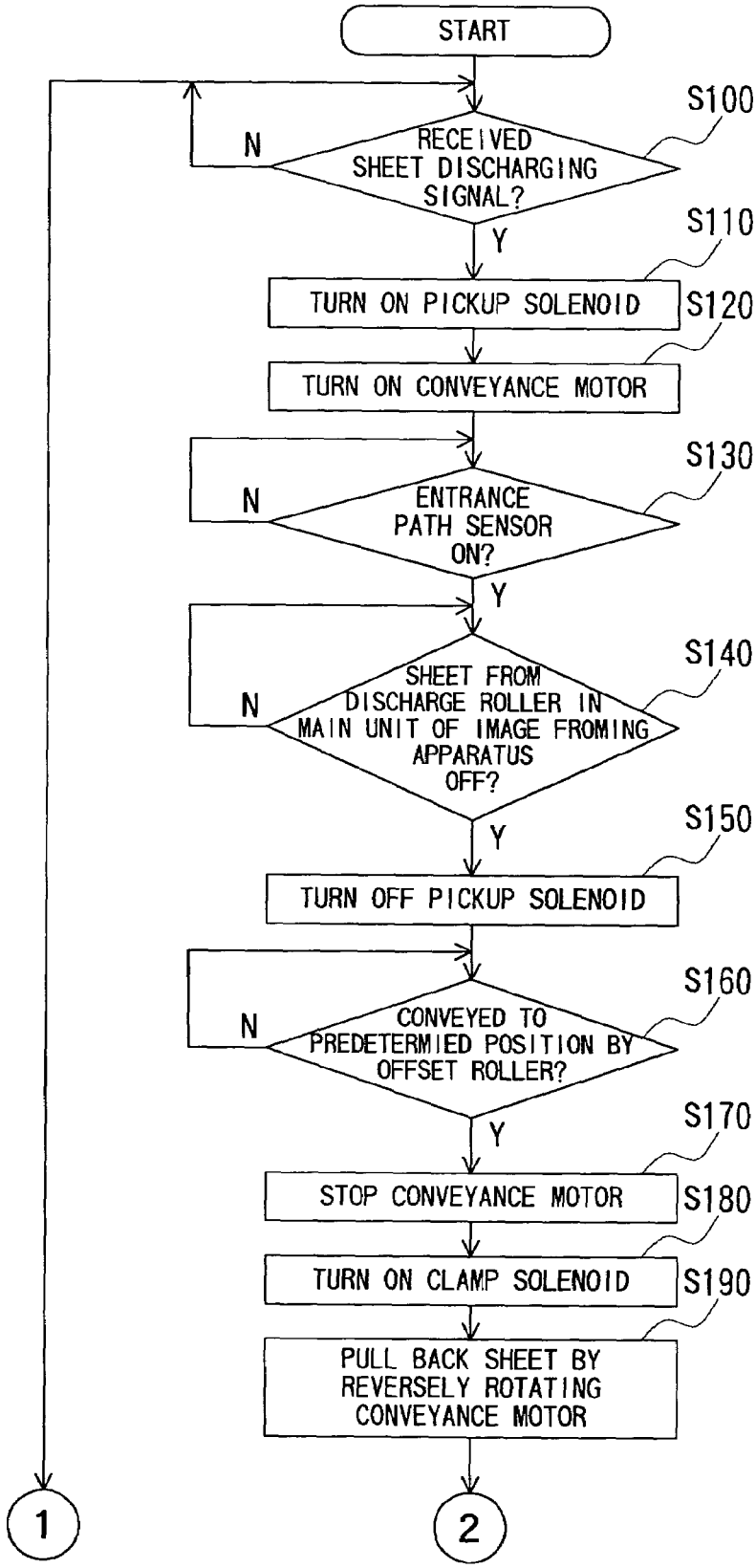
FIG. 8 is a flowchart for explaining operations of the inventive sheet post-processing unit.
Figure 9:
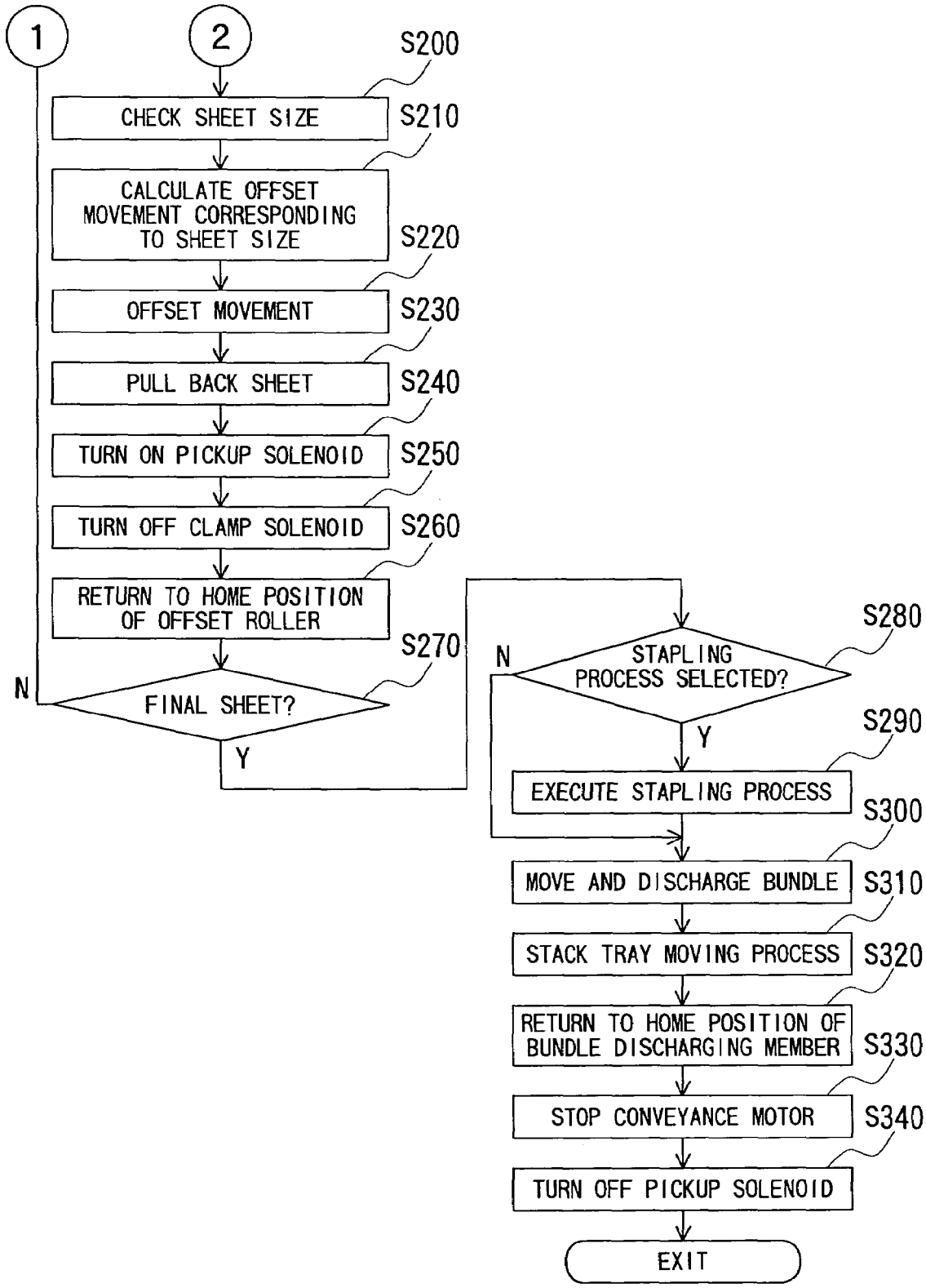
FIG. 9 is a flowchart continued from the flowchart in FIG. 8.

In FIG. 3A, as the control means of the sheet post-processing unit 400, the CPU 111 has a ROM 110 therein and controls each section by reading and executing a control program corresponding to flowcharts in FIGS. 8 and 9 stored in the ROM 110. The CPU 111 also contains a RAM 120. The RAM 120 stores work data 121 such as offset extent of move, sheet size and the like for example as shown in FIG. 3B and the CPU 111 controls each section based on those work data 121.

Figure 6:
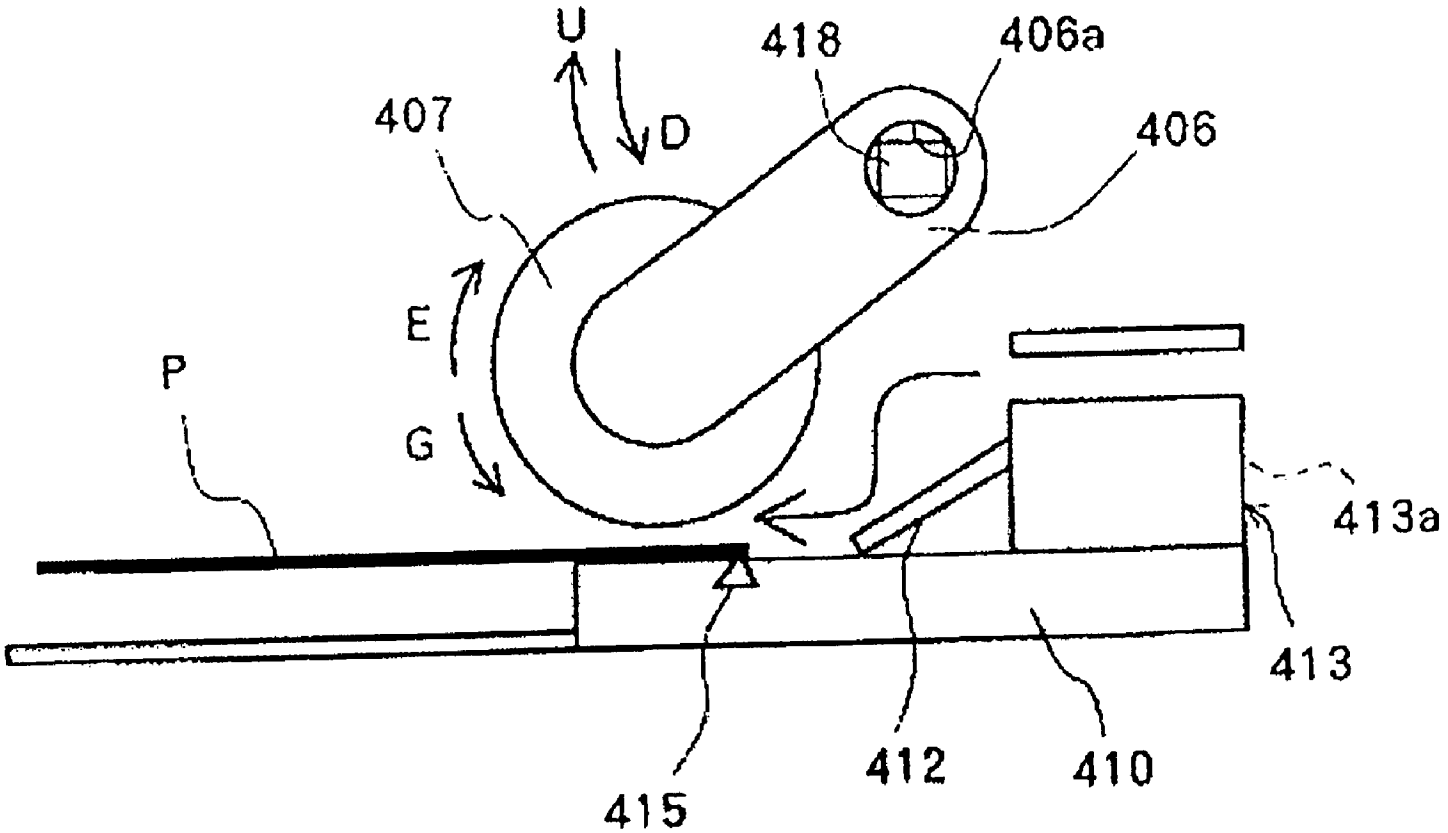
FIG. 6 is a schematic front view showing a disposition of the offset roller, the sheet bundle discharging member and a post-processing tray of the inventive sheet post-processing unit.
Figure 7:
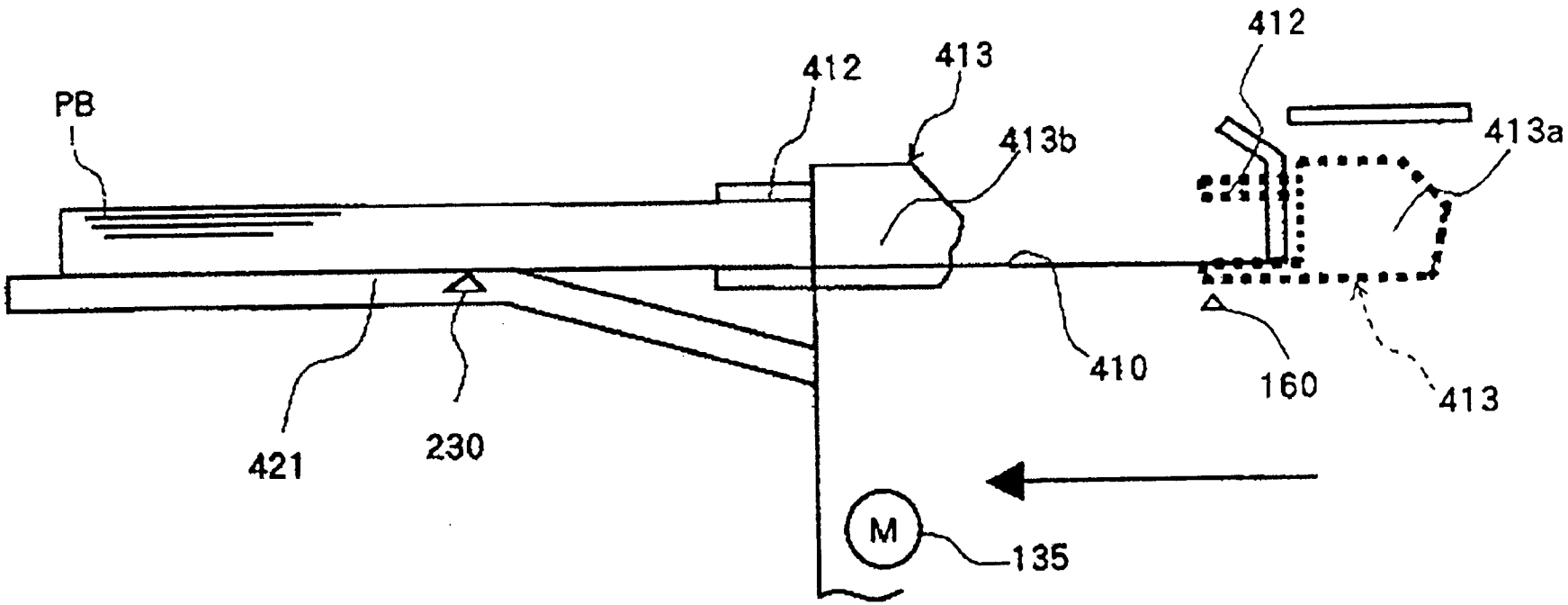
FIG. 7 is a schematic front view for explaining a moving operation of the sheet bundle discharging member of the inventive sheet post-processing unit.

Input ports of the CPU 111 are connected with sensors such as an entrance sensor 403 for detecting a sheet sent from the main unit 500A to a sheet receiving section 401 shown in FIG. 2, an offset home position sensor 150 for detecting whether or not the offset rollers 407 shown in FIG. 5 are located at the offset home position, a bundle discharge home position sensor 160 for detecting whether or not a sheet bundle discharging member 413 is located at its home position, a sheet bundle discharge sensor 230 for detecting whether or not a bundle of sheets is discharged to a stack tray 421 shown in FIG. 7 and a sheet discharge sensor 415 for detecting whether or not the sheet is discharged and stacked to the post-processing tray 410 shown in FIG. 6.

Figure 4:
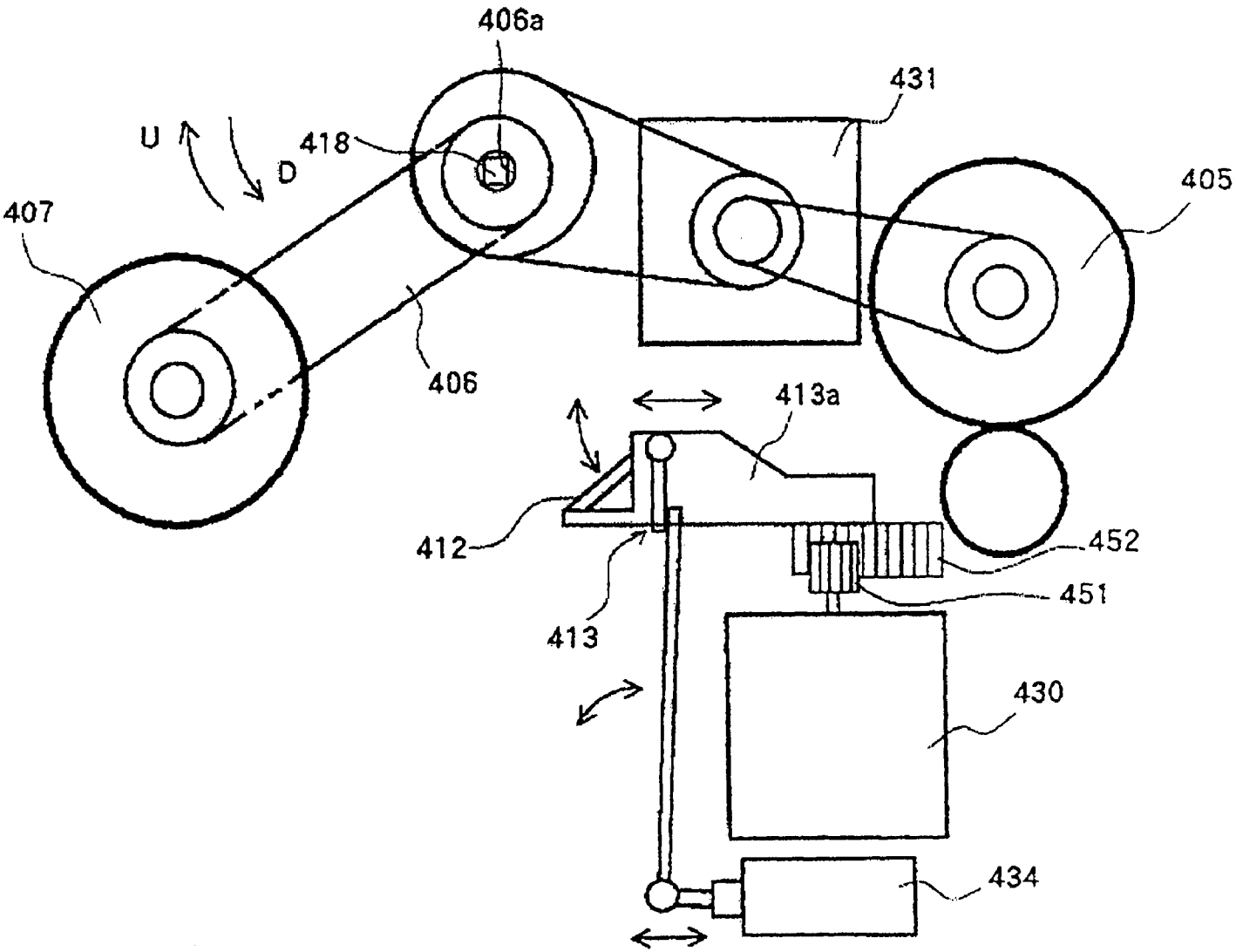
FIG. 4 is a schematic front view showing a mechanism for driving an offset roller and a conveying roller and a mechanism for driving a sheet bundle discharging member of the inventive sheet post-processing unit.

Output ports of the CPU 111 are connected with a conveyance motor 431 for rotating the offset rollers 407 shown in FIG. 5 in the directions of conveying the sheet to the downstream and upstream sides, an offset motor 432 for moving the offset rollers 407 in the direction intersecting with the sheet conveying direction to the home position and to the positioning wall 416 as the sheet aligning position, a sheet bundle discharging motor 430 for moving the sheet bundle discharging member 413 shown in FIG. 4 to a bundle discharging home position and to a sheet bundle discharging position, a stack tray elevating motor 135 for moving up and down the stack tray 421 shown in FIG. 7, a pickup solenoid 433 for elevating the offset rollers 407 shown in FIG. 5, a clamp solenoid 434 for opening/closing a sheet clamping member 412 shown in FIG. 4, and others.

Based on each detection signal of the respective sensors, the CPU 111 controls the respective motors, solenoids, the stapler unit 420 and others connected with the output ports in accordance to the program stored in the ROM 110 for executing the flowcharts shown in FIGS. 8 and 9.

The CPU 111 is also equipped with a serial interface section 130 to send/receive control data and control signals to/from the controller 501 of the main unit 500A of the copying machine 500. The CPU 111 controls each section based on the control data and control signals sent from the controller 501 of the main unit 500A via the serial interface section 130.

FIGS. 4 through 6 show a mechanism for driving the offset roller 407. The offset roller 407 is supported by the offset roller arm 406 turnable so as to rise or down in the directions of arrows U and D in the figures to be able to receive the sheet on the post-processing tray 410. The offset roller arm 406 is turnably supported by the square shaft 418 having a square section and inserted into a round hole 406*a* formed in the arm. Note that the offset roller arm 406 is shown as if it is disposed on the outside of the pair of offset rollers 407 in FIG. 6, FIGS. 10 through 16, and FIGS. 23, 24, 27 and 28 in order to facilitate the understanding on the structure thereof, it is actually disposed between the pair of offset rollers 407 as shown in FIG. 5.

The offset roller arm 406 is structured to move up and down by actuating the pickup solenoid 433, i.e., an actuator (vertical moving means), via a down lever. It is noted that the actuator is not limited to be a solenoid and may be another actuator such as an electric actuator. The conveyance motor 431 rotates the offset roller 407 via the belt 435, the square shaft 418, the pulley 442, the belt 437 and the pulley 443. That is, the conveyance motor 431 rotates the conveying roller 405 and the offset roller 407 in the sheet conveying direction or in the reverse direction thereof to the extent corresponding to its rotation. The pulley 442 is connected with the square shaft 418 by inserting the shaft into a square hole not shown so as to rotate in a body with the square shaft 418 through the engagement of the square hole with the square shaft 418 and to be able to move along the square shaft 418.

A rack supporting member 444 in a shape of U when seen in plan and having a rack 441 is disposed between the pair of offset roller arms 406 while being supported by the square shaft 418. The rack supporting member 444 is turnably attached to the square shaft 418 through a round hole not shown. Thereby, the rack supporting member 444 does not rotate following the square shaft 418 even if the square shaft 418 rotates, though it is able to move along the square shaft 418 in the thrust direction. The rack 441 is engaged with a pinion 439 provided on an output shaft of the stationary offset motor 432. The pickup solenoid 433 is arranged so as to be movable along the square shaft 418.

Accordingly, the belt 437, the pulley 443, the offset roller arm 406 and the offset roller 407 are turnable and movable up and down in the direction of the arrows U and D in FIG. 4 centering on the square shaft 418 and are movable close to or apart from the stapler unit 420 by being guided by the square shaft 418 and with the move of the rack supporting member 444.

When the sheet discharge sensor 415 detects that a sheet is stacked on the post-processing tray 410 and the pickup solenoid 433 is turned off, the offset roller 407 drops by its own weight, presses the upper face of the sheet and conveys the sheet to the downstream side so that the whole sheet is stacked on the post-processing tray 410.

After conveying the sheet to the post-processing tray 410, the offset roller 407 stops and rotates in the reverse direction to hit the upstream edge of the sheet against a trailing edge stopper 411 for example as regulating means (member) for regulating the upstream edge (trailing edge) of the sheet, i.e., a reference position for aligning the sheet in the sheet conveying direction, and to align the upstream edge of the sheet.

Further, when the offset motor 432 rotates, the pinion 439 and the rack 441 moves the offset roller 407 to the positioning wall 416 for example as intersectional regulating means (member) for regulating the sheet in the direction intersecting with the sheet conveying direction, i.e., a reference position for aligning the sheet in the width direction, which is also the stapling position of the stapler unit 420 as shown in FIG. 5. The offset roller 407 is moved toward the positioning wall 416 for the purpose of moving the sheet to the positioning wall 416 by causing the sheet to follow the offset roller 407 by utilizing the contact friction of the offset roller 407 against the sheet.

That is, the sheet which has been aligned at the aligning position in the sheet conveying direction (the position for hitting against the trailing edge stopper 411) is moved to the positioning wall 416 in the direction intersecting with the sheet conveying direction by the frictional force of the offset roller 407. After hitting the side edge of the sheet against the positioning wall 416, the offset roller 407 continuously moves while sliding on the sheet and then stops. Sliding thus on the sheet, the offset roller 407 can steadily align the sheet with the positioning wall 416.

It is noted that a hollow roller whose outer periphery is formed by using such material as ethylene propylene rubber (EPDM) is used for the offset roller 407 in the present embodiment in order to obtain the more effective aligning effect as described above. As for the material of the roller, elastic members having elasticity close to rubber such as urethane foam and sponge may be used beside the EPDM.

FIGS. 4, 6 and 7 show a structure of a sheet bundle discharging member 413 for example as transfer means for transferring the sheets on the post-processing tray 410 to the stack tray 421 and as clamping means for clamping the sheets. The sheet bundle discharging member 413 disposed in the vicinity of the trailing edge stopper 411 is arranged so as to move closer to or apart from the stack tray 421 by means of a pinion 451 and a rack 452 when the sheet bundle discharging motor 430 turns on. The sheet bundle discharging member 413 is fixed at its home position by magnetization of the sheet bundle discharging motor 430. A sheet clamping member 412 of the sheet bundle discharging member 413 opens/closes in the vertical direction as indicated by an arrow in FIG. 4 when the clamp solenoid 434 is actuated.

In the structure described above, the controller 501 of the main unit 500A to which the sheet post-processing unit 400 is attached as shown in FIG. 1 recognizes the size of the sheet discharged from the sheet discharging section 208. Therefore, the CPU 111 of the sheet post-processing unit 400, composed of a microcomputer system that conducts serial communication with the controller 501 of the main unit 500A, is able to recognize the size of the sheet conveyed to the post-processing tray 410 and whether or not the stapling process is to be carried out on the sheets.

FIGS. 4 and 7 show the schematic structure of a sheet bundle discharging mechanism.

The sheet bundle discharging member 413 as the sheet clamping means moves from its home position 413*a* to a bundle discharging position 413*b* toward the stack tray 421 to discharge the bundle of sheets PB, aligned through the aligning operation of the offset roller 407 on the post-processing tray 410 as described later, from the post-processing tray 410 to the stack tray 421 while clamping the bundle of sheets PB. The sheet bundle discharging motor 430 moves the sheet bundle discharging member 413 by rotating the pinion 451 and by moving the rack 452. The bundle discharge home position sensor 160 detects the home position 413*a* of the sheet bundle discharging member 413. The sheet bundle discharging sensor 230 provided in the vicinity of the stack tray 421 detects whether or not a bundle of sheets is discharged to the stack tray 421.

The bundle of sheets PB stacked on the stack tray 421 composes a part of the post-processing tray 410 in the sheet post-processing unit 400 of the present embodiment and when the sheet bundle PB is discharged from the post-processing tray 410, the stack tray elevating motor 135 lowers the stack tray 421 to the position where the height of the uppermost face of the bundle of sheets PB stacked on the stack tray 421 is almost equalized with the height of the post-processing tray 410.

Next, the operation of the sheet post-processing unit 400 of the present embodiment will be explained with reference to the block diagram in FIG. 3, the flowcharts shown in FIGS. 8 and 9, FIGS. 1 and 2, FIGS. 4 through 7 and FIGS. 10 through 16.

When the main unit 500A of the copying machine 500 starts a copying job, the CPU 111 of the sheet post-processing unit 400 checks whether or not it has received a sheet discharging signal from the controller 501 of the copying machine 500 in Step 100 (abbreviated as S100 hereinafter). When the CPU 111 receives the sheet discharging signal from the controller 501 via the serial interface section 130, it drives the pickup solenoid 433 shown in FIG. 5 to turn the offset roller arm 406 in the direction of the arrow U shown in FIGS. 4 and 6 and to raise the offset roller 407 supported by the offset roller arm 406 (S110). The position of the raised offset roller 407 is indicated in FIG. 10 by dotted lines.

Figure 10:
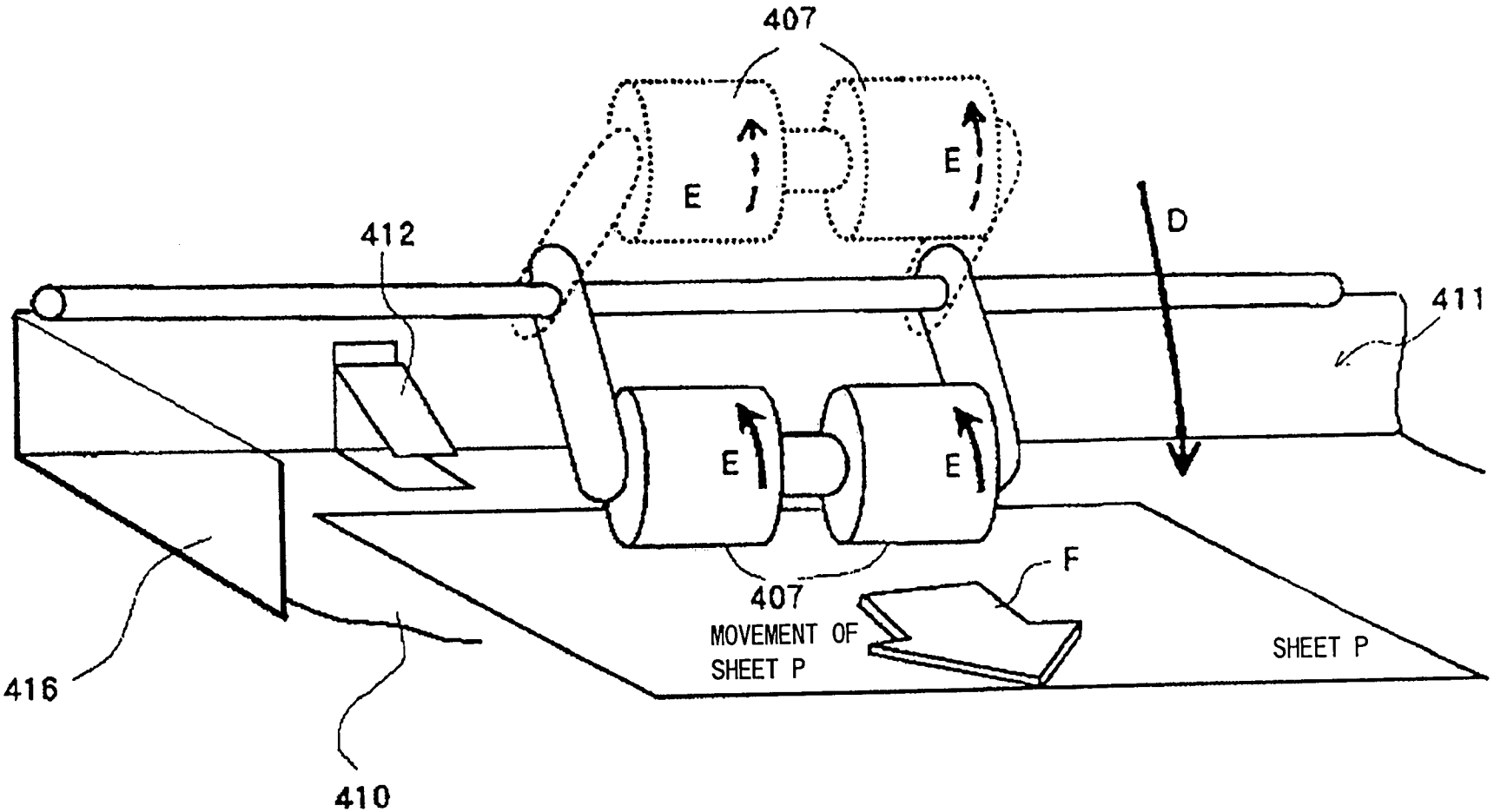
FIG. 10 is a perspective view of the offset rollers and others when a sheet is discharged to the post-processing tray in the inventive sheet post-processing unit.
Figure 11:
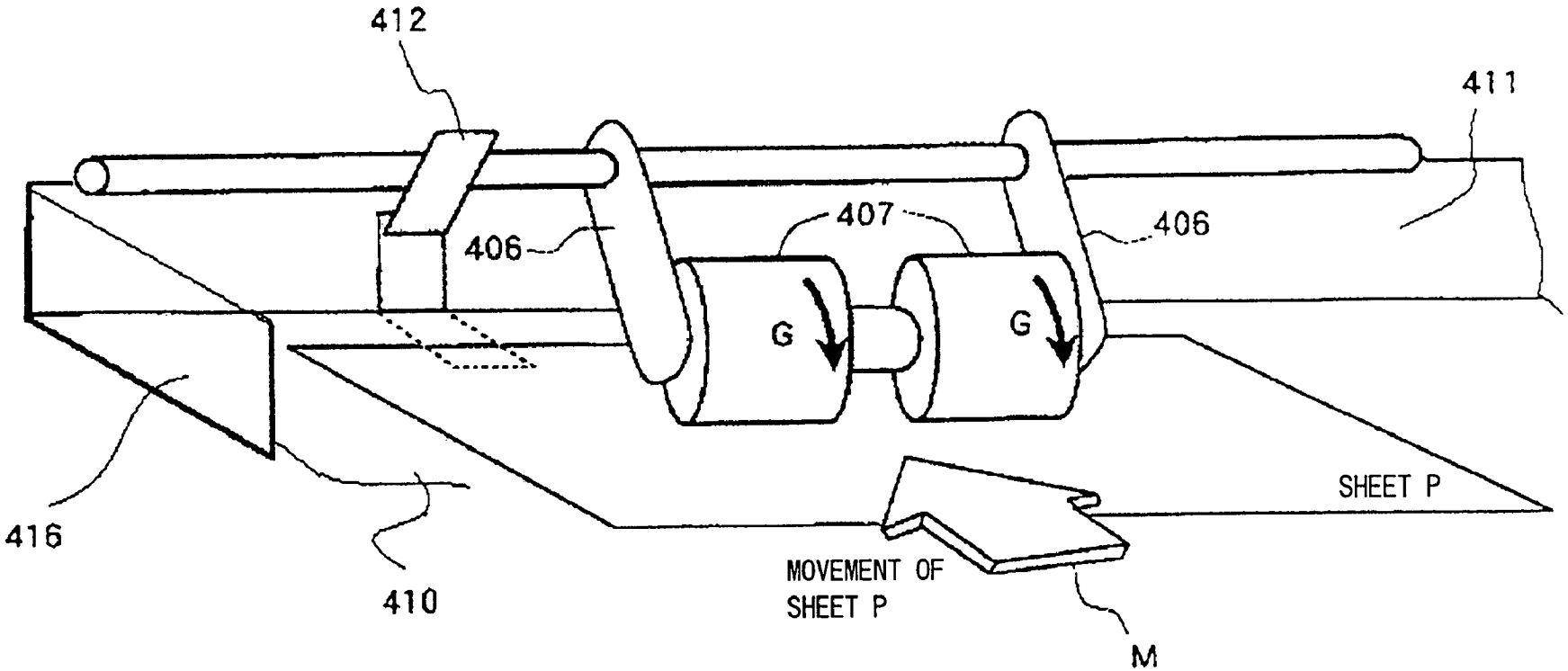
FIG. 11 is a perspective view of the offset rollers and others when the offset roller is conveying the sheet toward a trailing edge stopper in the inventive sheet post-processing unit.

Next, the CPU 111 starts the conveyance motor 431 to rotate the conveying roller 405 and the offset roller 407 that rotates in the conveying direction in synchronism with the conveying roller 405 in the direction an arrow E in FIG. 10 so as to be able to convey the sheet in the same direction with the sheet discharging direction of the copying machine (S120). Thereby, the offset roller 407 rises, rotates and waits for the sheet to be conveyed.

When the leading edge of the first sheet passes through the entrance sensor 403 (S130), the sheet arrives at the conveying roller 405, motive power of the conveying roller 405 is transmitted to the sheet and the sheet leaves from the sheet discharging section 208 within the main unit 500A of the copying machine 500, the delivery of the sheet is completed (S140).

While conveying the sheet to the post-processing tray 410 by the conveying roller 405, the CPU 111 turns off the pickup solenoid 433 (S150) before the sheet comes out of the conveying roller 405 to cause the offset roller 407 to land on the sheet by its own weight and to press the surface of the sheet as shown by solid lines in FIG. 10. While the offset roller 407 has been already rotating in the direction of an arrow E, the conveyance motor 431 continues its rotation to convey the sheet in the direction of an arrow F, i.e., in the downstream direction. When the sheet is conveyed to a predetermined position where the sheet discharge sensor 415 shown in FIG. 6 detects the trailing edge of the sheet P (S160), the CPU 111 stops the conveyance motor 431 to stop the rotation of the offset roller 407 once and to stop the conveyance of the sheet in the direction of the arrow F (S170).

At the moment when the rotation of the offset roller 407 stops, the CPU 111 turns on the clamp solenoid 434 shown in FIG. 4 (S180) to open the sheet clamping member 412 provided in the vicinity of the trailing edge stopper 411.

Figure 12:
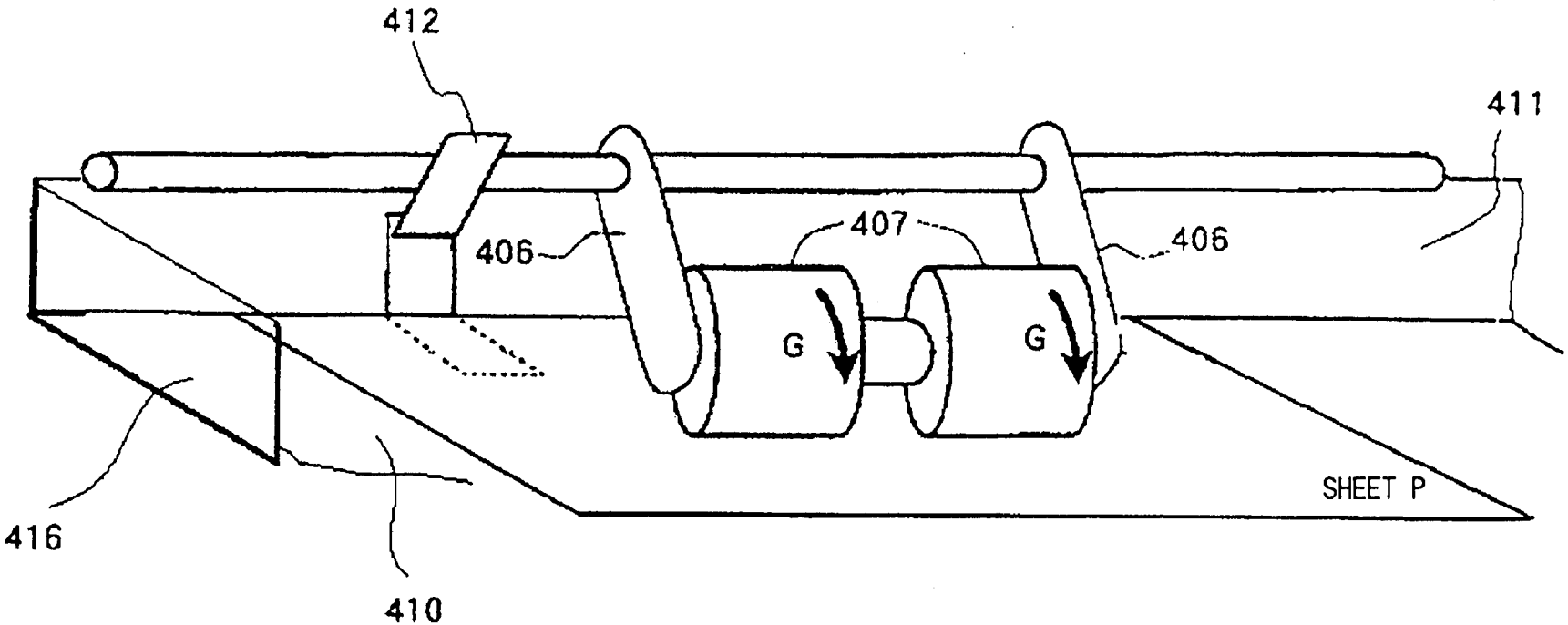
FIG. 12 is a perspective view of the offset rollers and others when the offset rollers abut the sheet against the trailing edge stopper in the inventive sheet post-processing unit.

After that, the CPU 111 rotates the conveyance motor 431 in the reverse direction from the sheet conveying direction. Along that, the offset roller 407 rotates reversely in the direction of an arrow G in FIG. 11, pulls back the sheet in the direction of an arrow M, i.e., in the upstream direction, hits the upstream edge (trailing edge) of the sheet against the trailing edge stopper 411 (S190) as shown in FIG. 12 and then stops to rotate.

Here, the CPU 111 controls a number of rotation of the offset roller 407 in hitting the sheet against the trailing edge stopper 411 and rotates the offset roller 407 so as to be able to convey the sheet slightly more than a distance from the point where the conveyance of the sheet is stopped and is reversed to the trailing edge stopper 411 by taking account of obliqueness of the sheet occurring when it is sent from the main unit 500A of the copying machine 500. It allows the upstream edge of the sheet to be steadily hit against the trailing edge stopper 411 and the obliqueness of the sheet to be corrected.

Next, the CPU 111 checks size data of the sheet discharged from the copying machine 500 from work data 121 stored in the RAM 120 (S200) and calculates an extent of offset movement corresponding to the size of the sheet to be discharged, i.e., a moving distance necessary for pressing the sheet against the positioning wall 416 in the width direction of the sheet put on the post-processing tray 410 (S210).

Figure 13:
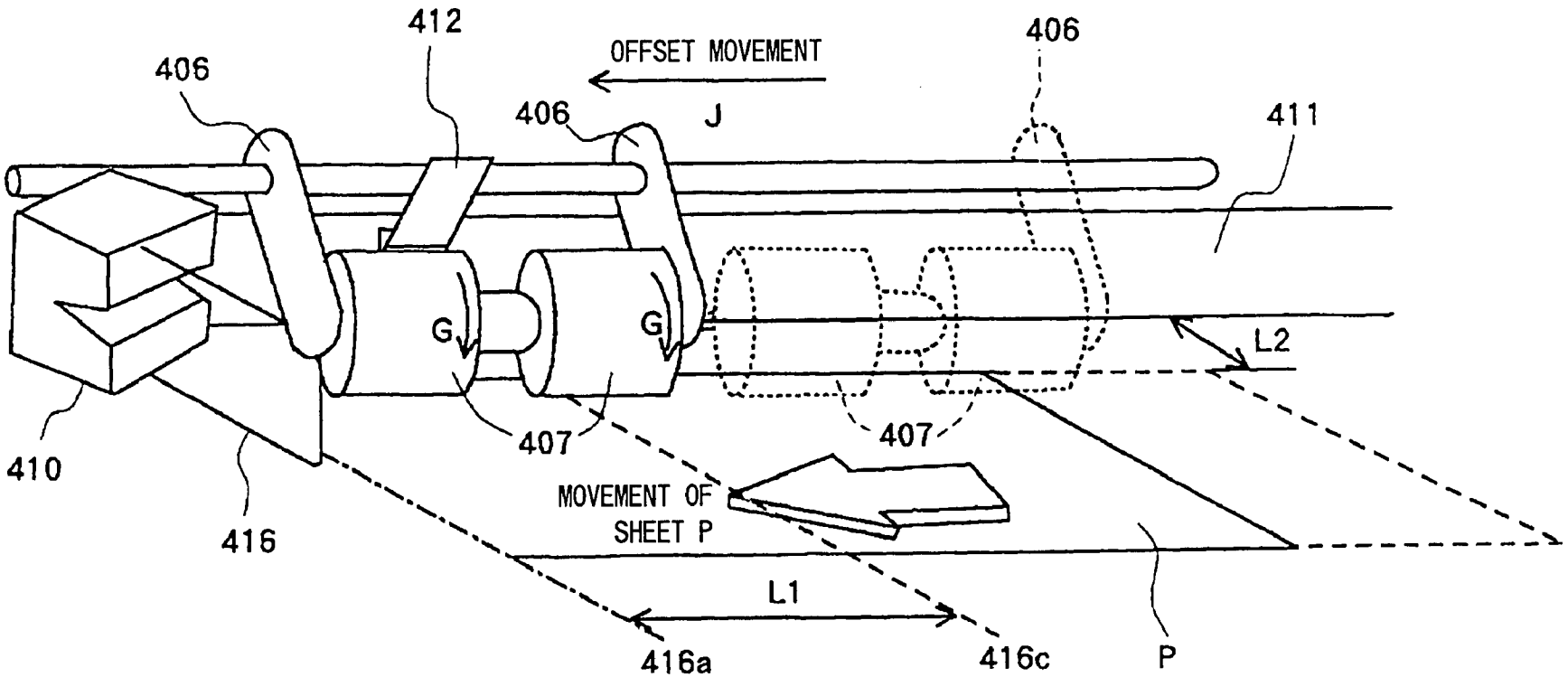
FIG. 13 is a perspective view of the offset rollers and others when the offset rollers have moved the sheet to an aligning position in the inventive sheet post-processing unit.

The CPU 111 starts the offset motor 432 to move the offset roller 407 via the rack and the pinion in offset by a predetermined distance in the direction of an arrow J from the position of dotted lines to the position of solid lines as shown in FIG. 13 (S220).

The sheet in contact with the offset roller 407 moves together with the offset roller 407 in the direction of the positioning wall 416 due to the frictional force of the offset roller 407. After hitting the side edge of the sheet against the positioning wall 416, the offset roller 407 stops after slightly sliding on the sheet. After that, the CPU 111 rotates the conveyance motor 431 in the reverse direction from the sheet conveying direction in order to correct disturbance of alignment of the sheet in the sheet conveying direction after the offset move. Along that, the CPU 111 rotates the offset roller 407 again in the reverse direction (in the direction of the arrow G) from the conveying direction to correct the alignment of the upstream edge of the sheet and stops the rotation of the conveyance motor 431 to stop the rotation of the offset roller 407. The CPU 111 completes the alignment of the first sheet by carrying out the alignment correcting operation of the upstream edge of the sheet (S230) as described above.

Figure 14:
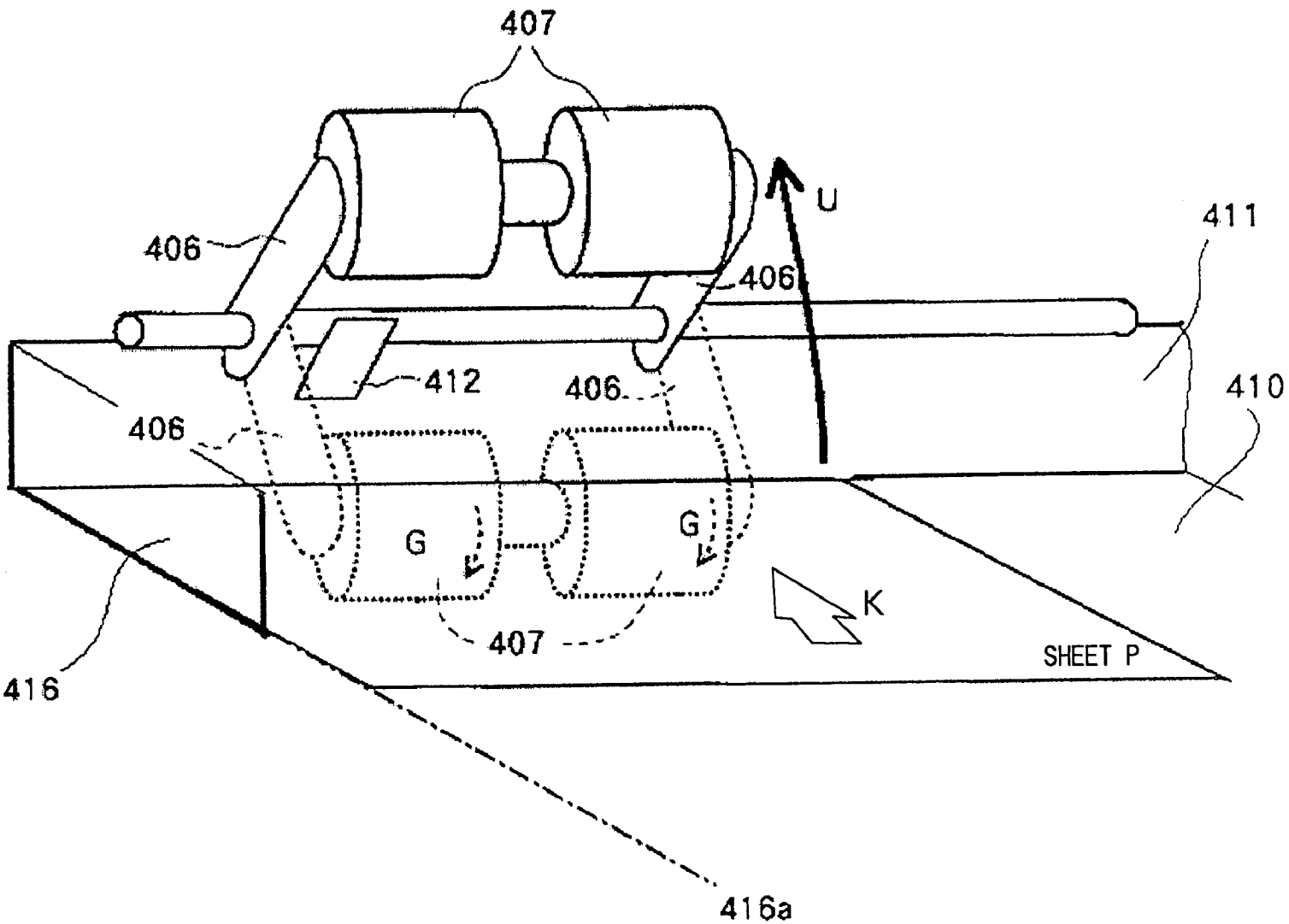
FIG. 14 is a perspective view of the offset rollers and others when the offset rollers have separated from the sheet after moving the sheet to the aligning position in the inventive sheet post-processing unit.

Next, the CPU 111 turns on the pickup solenoid 433 to raise the offset roller 407 in the direction of the arrow U shown in FIG. 14 (S240) and then turns off the clamp solenoid 434 to close the sheet clamping member 412 and to press and hold the aligned sheet (S250).

Figure 15:
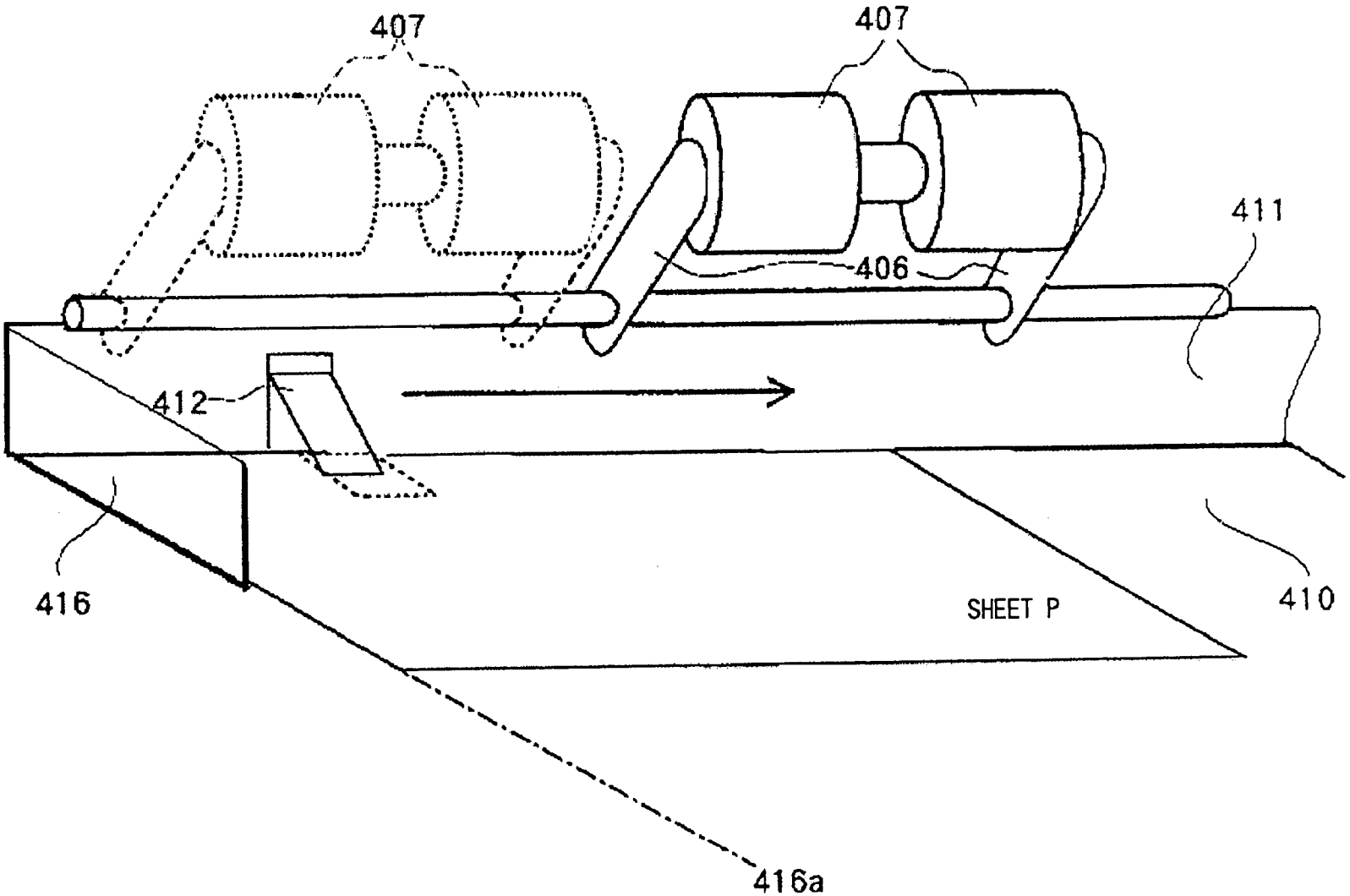
FIG. 15 is a perspective view of the offset rollers and others when a sheet clamping member presses the sheet against the post-processing tray and the offset rollers have returned to its offset home position.
Figure 16:
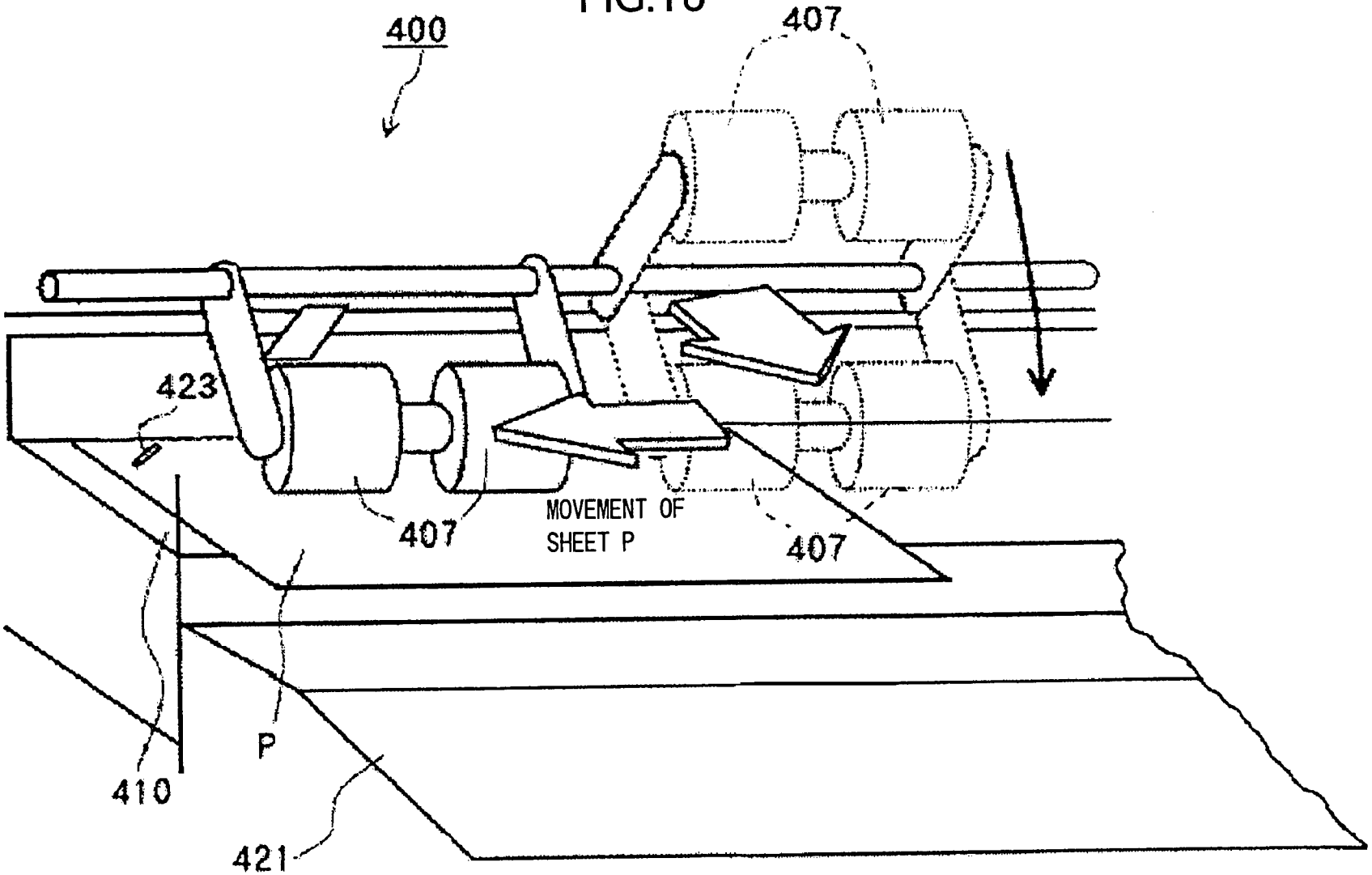
FIG. 16 is a perspective view of the offset rollers and others for explaining the operation of the offset rollers and the moves of the sheet following such operation in the inventive sheet post-processing unit.

Because the sheet discharged first is thus pressed and held by the sheet clamping member 412 in the state in which the upstream edge thereof is aligned by the trailing edge stopper 411 and the side edge thereof is aligned by the positioning wall 416 (at position 416*a*) as shown in FIG. 15, it will not be influenced by a sheet discharged next and thereafter and conveyed in the sheet conveying direction that otherwise causes feed-in-tow for example and is able to keep the aligned state.

Next, the CPU 111 drives the offset motor 432 to move the offset rollers 407 via the rack and the pinion from the position indicated by the dotted lines to the home position indicated by the solid lines while lifting them up as shown in FIG. 15 (S260). By receiving a detection signal of the offset home position sensor 150 shown in FIGS. 3 and 5, the CPU 111 recognizes the home position and controls the drive of the offset motor 432.

After that, the CPU 111 checks whether or not the sheet stored on the post-processing tray 410 is a sheet corresponding to the final page of the copied document (S270) based on the information sent from the main unit 500A of the copying machine 500. When it judges that it is not the final page based on the information sent from the main unit 500A, the CPU 111 returns to Step 100 to receive a sheet discharging signal sent next from the controller 501 of the copying machine 500 and repeats the above-mentioned flow until when the sheet of the final page is stored in the post-processing tray 410. Thereby, the control section of the sheet post-processing unit 400 recognizes the size of a sheet every time when the sheet is discharged from the main unit 500A of the copying machine 500 and calculates an extent of offset movement suited for the sheet. The sheet in contact with the offset roller 407 is subjected to the aligning process based on the calculated extent of movement and is steadily aligned to the positioning wall 416.

Because a bundle of sheets corresponding to the copied documents is supposedly formed on the post-processing tray 410 when it is judged to be the final page on the other hand, the CPU 111 checks whether or not the stapling process is being selected (S280). When the stapling process is being selected, the CPU 111 drives the stapler unit 420 shown in FIG. 5 to execute the stapling process (S290).

When the stapling process is completed or the stapling process is not being selected, the CPU 111 controls the sheet bundle discharging motor 430 via the pinion 451 and the rack 452 to advance the sheet bundle discharging member 413 clamping the bundle of sheets in the direction of the stack tray 421 to the sheet bundle discharging position 413*b* from the home position 413*a* as shown in FIG. 7 and actuates the clamp solenoid 434 to discharge the bundle of sheets to the stack tray 421 (S300).

After that, the CPU 111 controls the stack tray elevating motor 135 to lower the stack tray 421 by a distance almost equal to the thickness of the bundle of sheets (S310).

Then, the CPU 111 reverses the sheet bundle discharging motor 430 to return the sheet bundle discharging member 413 to its home position 413*a* (S320), stops the conveyance motor 431 to stop the rotation of the conveying roller 405 and the offset roller 407 (S330), turns off the pickup solenoid 433 to lower the offset roller 407 (S340) and ends the series of processes.

It is noted that although the stationary stapler disposed in the vicinity of the positioning wall 416 is used in the present embodiment, it is also possible to staple another part or a plurality of parts of the bundle of sheets when a plurality of staplers or a mobile type stapler is used.

Still more, although the roller member is used as means for conveying the sheet and to align the sheet in the present embodiment, the same effect may be obtained by adopting not the rotation of the roller but a mechanism wherein a member itself is movable both in the front and rear in the conveying direction or a mechanism wherein the member moves the sheet in the direction intersecting with the conveying direction as sheet conveying-direction moving means or sheet intersectional moving means in moving the sheet on the post-processing tray conveyed thereto by the sheet conveying means to the trailing edge stopper.

Further, although the CPU 111 makes control by reading a program corresponding to the flowchart shown in FIGS. 8 and 9 stored in the ROM 110, the same effect may be obtained by arranging so that the hardware executes the processes on the control program.

Next, a modification of the inventive sheet post-processing unit, equipped with a sheet bundle trailing edge hitting member operable in discharging a bundle of sheets by the sheet bundle discharging member 413 and a pressing arm for pressing the bundle of sheets on the stack tray, will be explained with reference to FIGS. 17 and 18.

Figure 17:
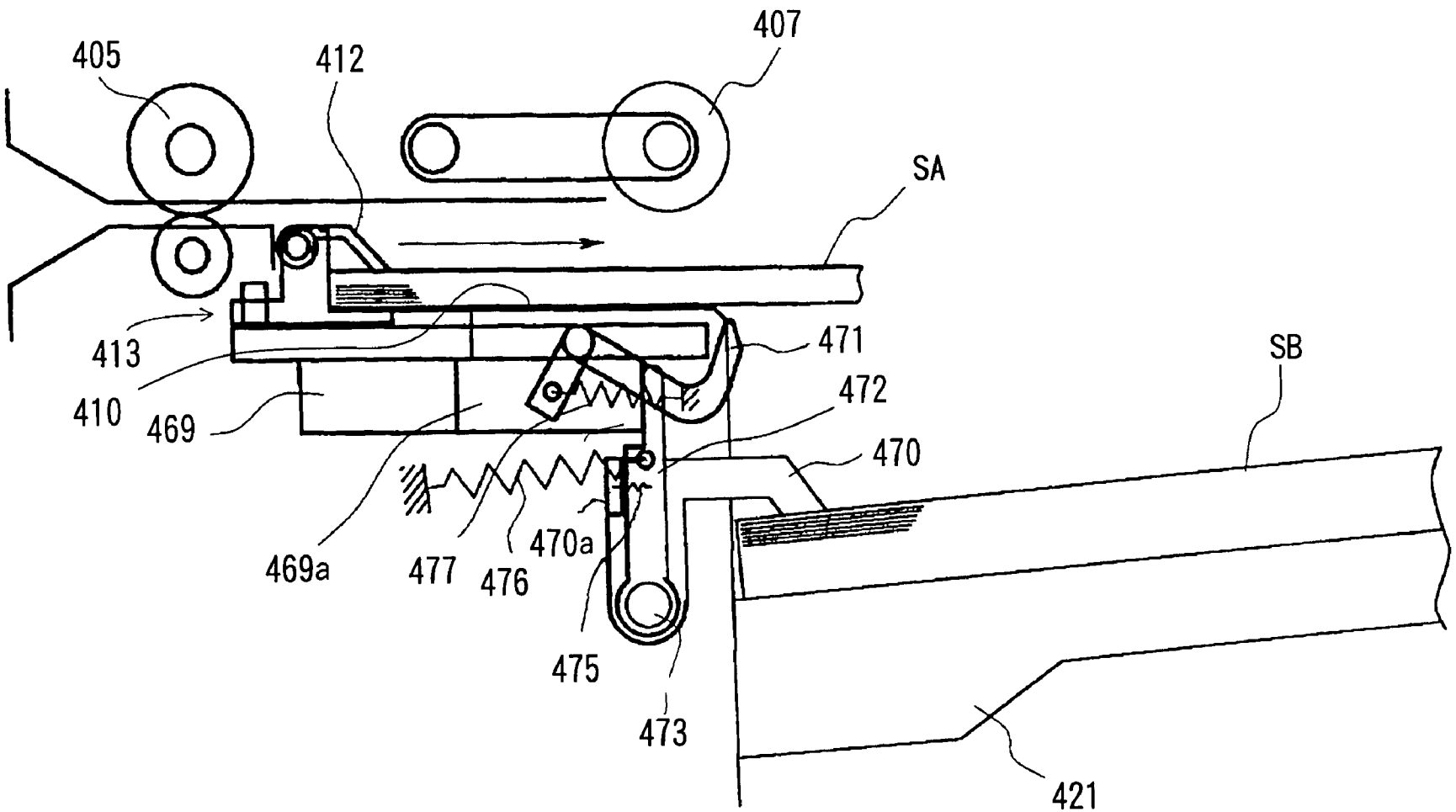
FIG. 17 is a schematic front view showing a modification of the inventive sheet post-processing unit, in which a sheet bundle trailing edge hitting member and a pressing arm for pressing sheets on a stack tray are provided.

The pressing arm 470, i.e., sheet bundle pressing means, is turnably provided under the post-processing tray 410 as shown in FIG. 17. The pressing arm 470 is provided to press a bundle of sheets SB discharged and stacked on the stack tray 421 from the top. Thereby, the bundle of sheets SB already stacked on the stack tray 421 will not be pushed out by the leading edge of a succeeding sheet when it is discharged to the post-processing tray 410.

Figure 18A:
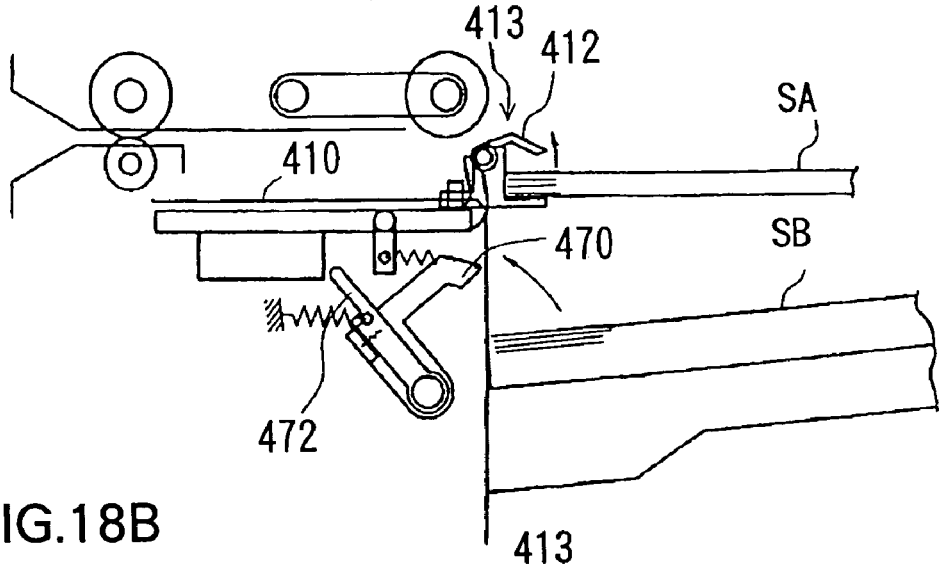

When the sheet bundle discharging member 413 discharges a bundle of sheets, the pressing arm 470 turns upward and evacuates under the post-processing tray 410 as shown in FIG. 18A so as not to obstruct another bundle of sheets SA from being discharged to the stack tray 421.

Accordingly, it becomes possible to prevent the bundle of sheets SB stacked on the stack tray 421 from slipping by pressing it by the pressing arm 470 from the top and to discharge the bundle of sheets SA to the stack tray 421 without being obstructed by the pressing arm 470 by moving the pressing arm 470 to the evacuation position in linkage with the move of the sheet bundle discharging member 413 in the sheet discharging direction. The sheet stackability may be thus improved with the simple structure.

The sheet bundle trailing edge hitting member 471 is provided at the discharging end portion of the post-processing tray 410 (the end portion on the side of the stack tray) so as to be able to go in and out as shown in FIG. 17. When the sheet bundle discharging member 413 arrives at the sheet bundle discharging position as shown in FIG. 18A, the sheet trailing edge hitting member 471 projects out of the post-processing tray 410.

Figure 18B:
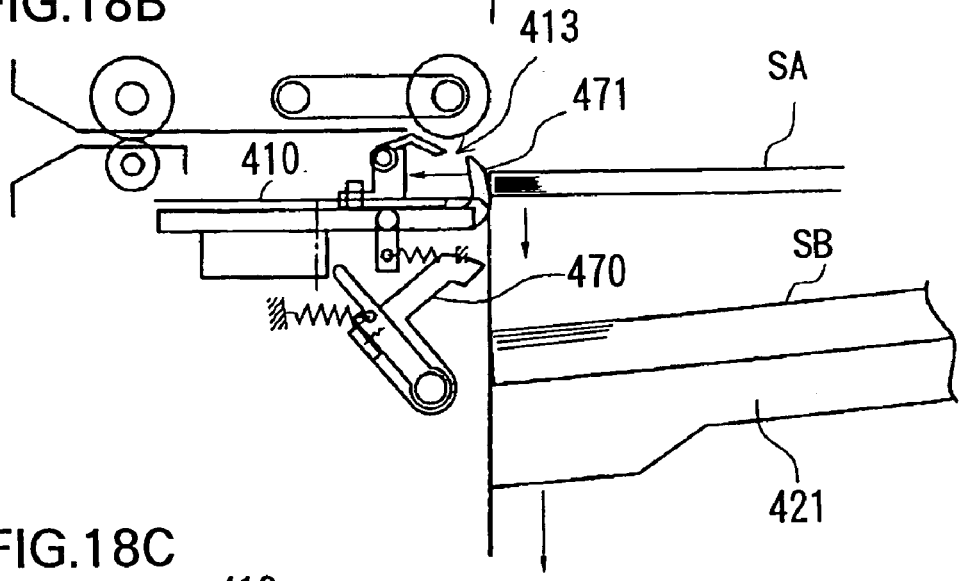

Then, when the sheet trailing edge hitting member 471 thus projects out and when the sheet clamping member 412 releases the bundle and the sheet bundle discharging member 413 moves toward the home position, the trailing edge of the bundle of sheet SA held by the sheet bundle discharging member 413 till then abuts against the sheet trailing edge hitting member 471 projecting at the discharging end of the post-processing tray 410 and drops there as shown in FIG. 18B. It then becomes possible to fix the position where bundles of sheets drop and to align the bundle on the bundle of sheets SB on the stack tray by abutting the bundle of sheets SA against the sheet trailing edge hitting member 471 as described above.

It is noted that in FIG. 17, a turning member 469 is turned by the sheet bundle discharging motor 430 and is provided with a cam portion 469*a* which is means for moving the pressing means for turning the pressing arm 470.

The cam portion 469*a* is driven so as to rotate centering on an axis in the vertical direction and rocks a lever 472, i.e., a cam follower, centering on a shaft 473. The pressing arm 470 is also rockably provided centering on the shaft 473. A spring 475 is stretched so that the lever 472 abuts against a rise portion 470*a* of the pressing arm 470, so that normally the lever 472 rocks together with the pressing arm 470. A spring 476 abuts the lever 472 against the cam portion 469*a*.

This turning member 469 is turned in moving the sheet bundle discharging member 413. When the sheet bundle discharging member 413 arrives at the sheet bundle discharging position, the lever 472 reaches to a low point of the cam portion due to the turn of the cam portion 469*a* that turns along the turn of the turning member 469 by the action of the spring 476. Thereby, the pressing arm 470 combined with the lever 472 moves to the evacuation position under the post-processing tray 410 from the sheet pressing position above the stack tray 421 as shown in FIG. 18A.

Figure 18C:
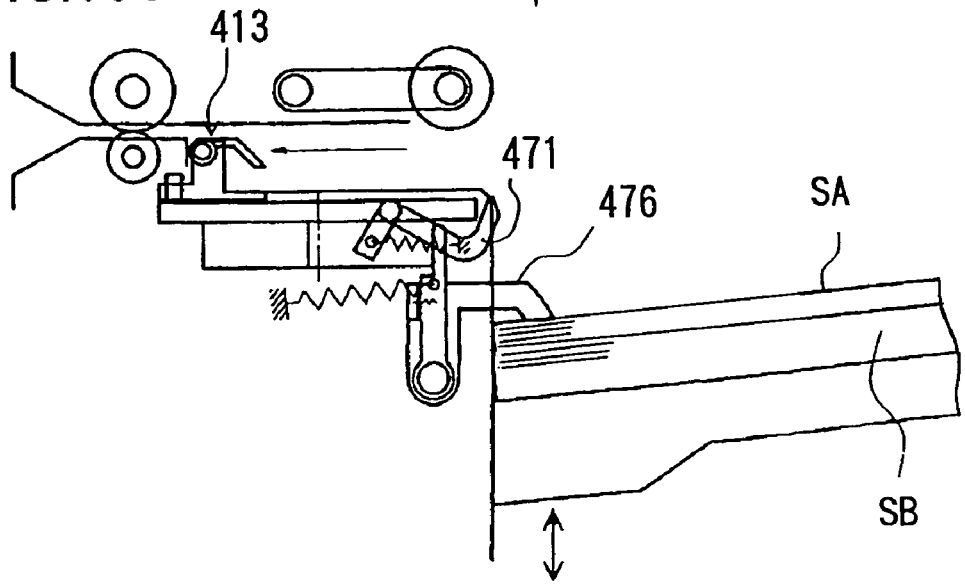

When the sheet bundle discharging member 413 returns to its home position after discharging the processed bundle of sheets SA, i.e., after stacking the bundle of sheets SA on the stack tray 421, the pressing arm 470 moves from the evacuation position under the post-processing tray 410 to the sheet pressing position above the stack tray 421,as shown in FIG. 18C by the action of the cam portion 469*a* along the turn of the turning member 469 thereafter and presses the bundle of sheets SA newly stacked on the stack tray 421 from the top.

It is noted that in the present modification, the stack tray elevating motor lowers the stack tray 421 by a predetermined distance so that the pressing arm 470 can press the bundles of sheets SA and SB approximately at the same height.

Still more, in the present modification, when the pressing arm 470 moves along the move of the sheet bundle discharging member 413 as described above, the sheet trailing edge hitting member 471 also projects above the post-processing tray 410 by the action of the cam portion not shown and provided in connection with the turning member 469 which is the means for moving the hitting member after when the sheet bundle discharging member 413 has arrived at the sheet bundle discharging position as shown in FIG. 18A.

The cam portion not shown is formed so as to project the sheet trailing edge hitting member 471 for a predetermined period of time when the sheet bundle discharging member 413 returns to its home position. Thereby, when the sheet bundle discharging member 413 returns to its home position after moving to the position for discharging the bundle of sheets, the bundle of sheets SA that is released from the sheet clamping member 412 abuts against the sheet trailing edge hitting member 471 and drops always at the same position on the stack tray 421.

Thus, it becomes possible to fix the position where the bundle of sheets drops and to align it on the bundle of sheets SB on the stack tray by projecting the sheet trailing edge hitting member 471 in linkage with the move of the sheet bundle discharging member 413. Still more, the mechanism may be simplified by moving not only the sheet trailing edge hitting member 471 but also the pressing arm 470 in linkage with the move of the sheet bundle discharging member 413 as described above.

It is noted that in FIG. 17, the spring 476 is biased in the direction of turning the pressing arm 470 upward through an intermediary of the lever 472. When the pressing arm 470 is pressed by the cam portion 469*a* of the turning member 469, it turns in the direction of pressing the sheets on the stack tray 421 by resisting against the force of the spring 476 and when it is released from the pressure of the cam portion 469*a*, it moves to the evacuation position by the force of the spring 476. Still more, because the spring 475 extends in taking out the bundle of sheet SB from the stack tray 421, the pressing arm 470 will not become an obstacle in taking out the bundle of sheets.

A spring 477 biases the sheet trailing edge hitting member 471 in the direction of turning upward. The sheet trailing edge hitting member 471 that is normally positioned at the evacuation position under the post-processing tray 410 by resisting against the force of the spring 477 projects above the post-processing tray 410 by the action of the cam portion not shown described above and of the spring 477 when the sheet bundle discharging member 413 returns to its home position.

Next, another modification comprising another sheet bundle trailing edge hitting member will be explained with reference to FIGS. 19 and 20.

Figure 19:
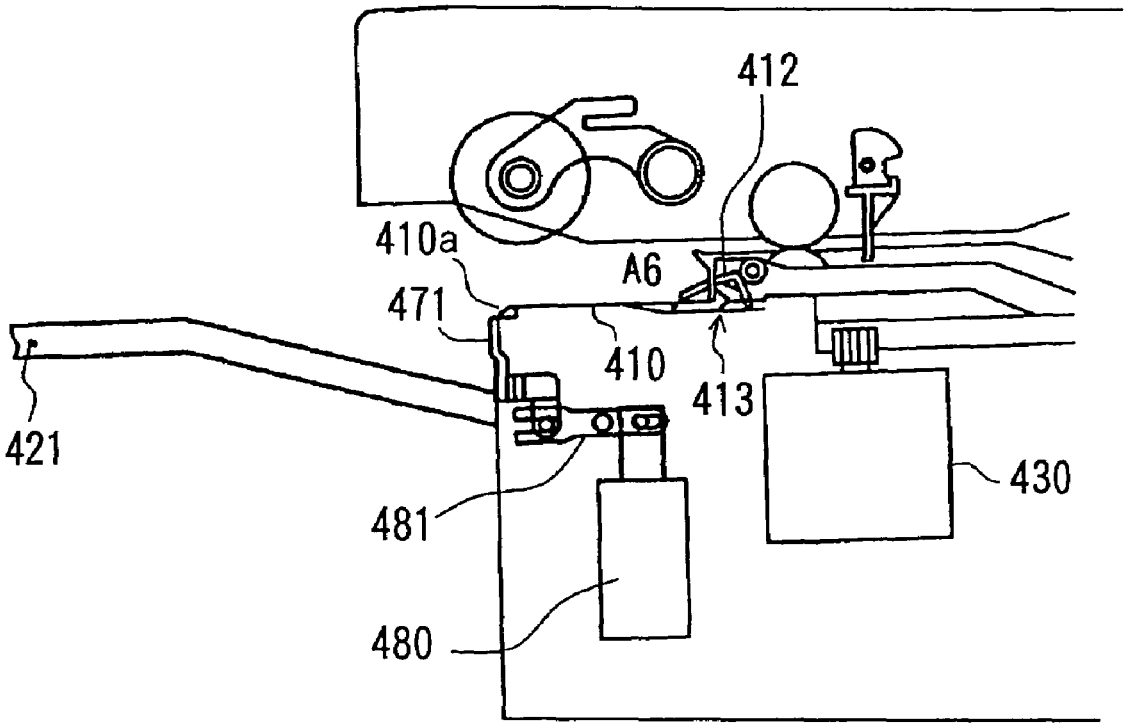
FIG. 19 is a schematic front view showing a different modification of the inventive sheet post-processing unit in which another sheet bundle trailing edge hitting member is provided and shows a state before a sheet is discharged to the post-processing tray.

As shown in FIG. 19, the sheet trailing edge hitting member 471 of the other modification is provided so as to be able to go in and out at the discharging end of the post-processing tray 410 (on the side of the stack tray). Here, when the sheet bundle discharging member 413 arrives at the position for discharging the bundle of sheets as shown in FIG. 20, the sheet trailing edge hitting member 471 projects out to the upstream side of the sheet bundle discharging member 413 from the post-processing tray 410.

When the sheet trailing edge hitting member 471 projects as described above and when the sheet clamping member 412 releases the bundle and the sheet bundle discharging member 413 moves in the direction of returning to its home position, the trailing edge of the bundle of sheets SA held by the sheet bundle discharging member 413 till then abuts against the sheet trailing edge hitting member 471 projecting at the discharging end of the post-processing tray 410, thus dropping there. Accordingly, it becomes possible to fix the position where the bundle of sheets drops and to align it on the bundle of sheets on the stack tray by abutting the bundle of sheets SA against the sheet trailing edge hitting member 471 and by dropping it there.

It is noted that the hitting solenoid 480 is means for moving a hitting member for projecting the sheet trailing edge hitting member 471. The CPU 111 (see FIG. 3) turns on the hitting solenoid 480 when it detects that the sheet bundle discharging member 413 has arrived at the sheet bundle discharging position by sensors and others not shown.

Figure 20:
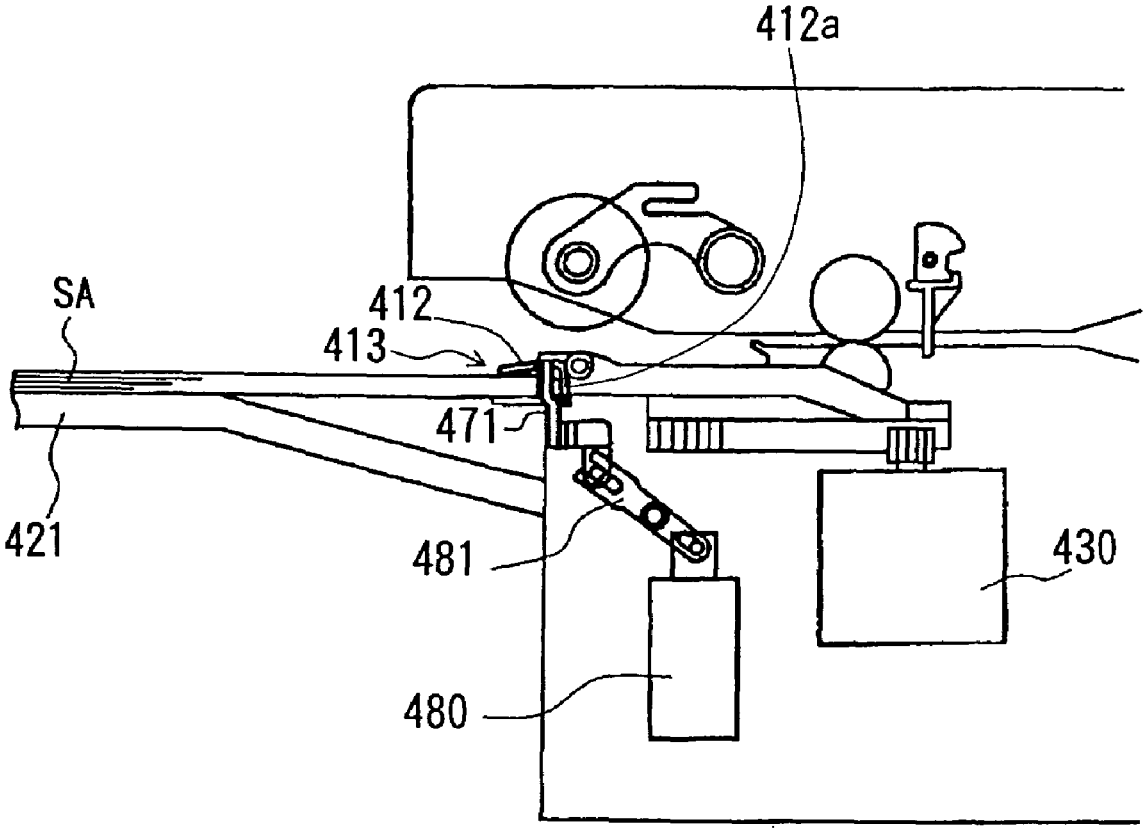
FIG. 20 is a schematic front view of the different modification of the inventive sheet post-processing unit, showing a state in which the sheet bundle discharging member has moved to a position for discharging a bundle of sheets to the stack tray.

Then, when the hitting solenoid 480 turns on, the sheet trailing edge hitting member 471 projects out through an intermediary of a link member 481 as shown in FIG. 20. When the hitting solenoid 480 is turned off, the sheet trailing edge hitting member 471 evacuates under the post-processing tray 410 so as not to obstruct the conveyance of sheet as shown in FIG. 19.

A hook portion 410*a* is formed at the front end and upper face of the post-processing tray 410 as shown in FIG. 19. When the lower end of a releasing lever portion 412*a* of the sheet clamping member 412 contacts with the hook portion 410*a* when the sheet bundle discharging member 413 returns to its home position after arriving at the bundle discharging position, the sheet clamping member 412 turns upward.

Here, the clamped bundle of sheets is released when the sheet clamping member 412 turns upward as described above. Thereby, when the sheet bundle discharging member 413 moves in the direction of returning to its home position, the trailing edge of the bundle of sheets SA abuts against the sheet trailing edge hitting member 471 projecting above the post-processing tray 410 and drops there.

Thus, it becomes possible to fix the position where the bundle of sheets drops by projecting the sheet trailing edge hitting member 471 after moving the sheet bundle discharging member 413 to the position for discharging the bundle of sheets SA and by hitting the trailing edge of the bundle of sheets SA that is released from the sheet clamping member 412 when the sheet bundle discharging member 413 returns to its home position.

It also enables to prevent ruggedness which is otherwise caused by inertia force of the bundle of sheets SA, to prevent ruggedness among the bundles of sheets and to improve the stackability of the bundle of sheets SA on the stack tray in stacking it on the stack tray 421 that is almost horizontal.

Figure 21:
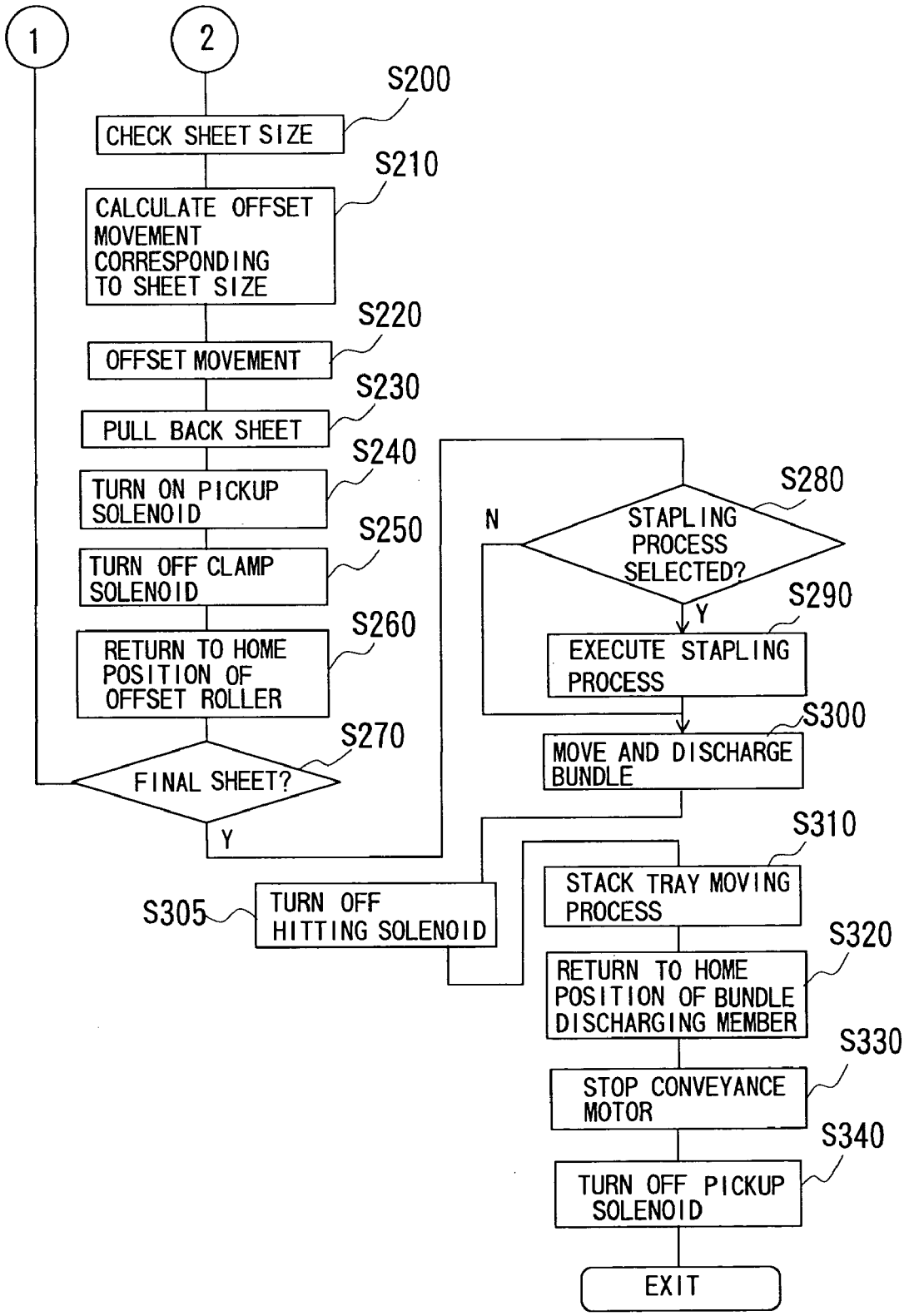
FIG. 21 is a flowchart, partially modified from the flowchart in FIG. 9, for explaining a part of the sheet processing operation of the inventive sheet post-processing unit.

FIG. 21 shows a flowchart in which the operation (S305) of the hitting solenoid described above is added to the flowchart shown in FIG. 9. The hitting solenoid 480 is turned on when the sheet bundle discharging member 413 arrives at the predetermined position near the end for discharging the bundle and is turned off when the sheet bundle discharging member 413 moves toward its home position or arrives at predetermined position on the way back.

Figure 22:
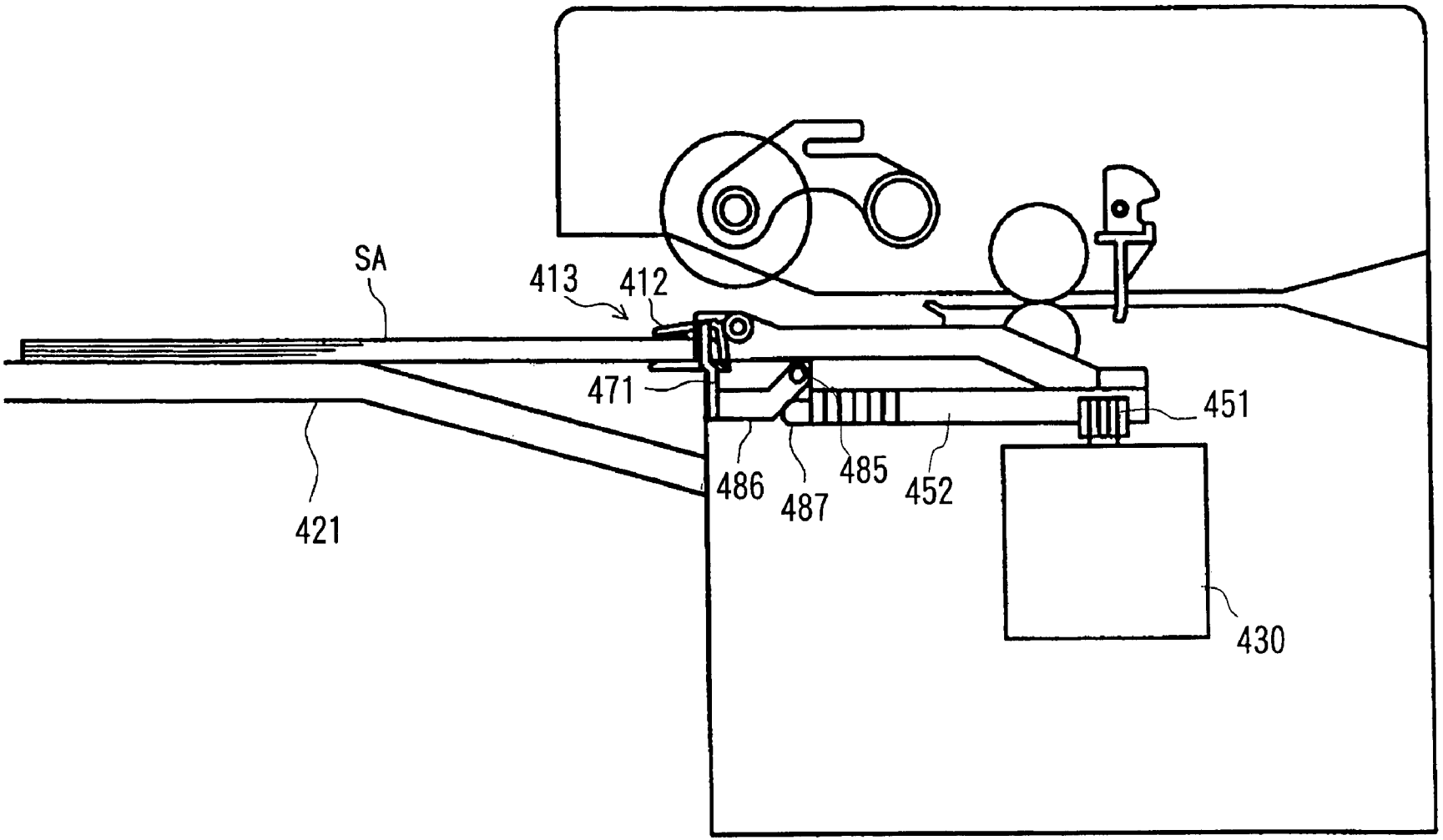
FIG. 22 is a schematic front view of a still different modification of the inventive sheet post-processing unit in which another sheet bundle trailing edge hitting member is provided and shows a state in which the sheet bundle discharging member has moved to a position for discharging a bundle of sheets to the stack tray.

FIG. 22 shows a still different modification comprising a still different sheet bundle trailing edge hitting member. This sheet trailing edge hitting member 471 is driven by the motor 430 that is the driving means of the sheet bundle discharging member 413, the pinion 451 and the rack 452. The sheet trailing edge hitting member 471 is secured to the front edge of an arm 486 turnably supported by a pin 485 under the post-processing tray 410. A pressing member 487 composed of a spring is provided at the front edge of the rack 452 for driving the sheet bundle discharging member so that the front edge of the pressing member 487 abuts against the arm 486.

Accordingly, when the sheet bundle discharging member 413 is moved in the direction of the stack tray 421 by the motor 430, the rack 452 and the pinion 451 and arrives at the position before the discharging end by a predetermined distance, the pressing member 487 provided at the front edge of the rack 452 abuts against the arm 486 and turns the sheet trailing edge hitting member 471 together with the arm in the direction of acting (projecting) position. In the state before the sheet bundle discharging member 413 comes to the discharging end, the front edge of the sheet trailing edge hitting member 471 abuts against the lower face of the bundle of sheets SA that is on the way to be discharged by the discharging member and its turn is restricted. That is, the pressing member 487 composed of the spring contracts and biases the sheet trailing edge hitting member 471 clockwise in the figure.

Then, when the sheet bundle discharging member 413 moves toward the discharging end and the restriction caused by the bundle of sheets is released, the sheet trailing edge hitting member 471 turns to the projecting position based on the biasing force described above. The sheet bundle discharging member 413 retreats in this state while releasing the sheet clamping member 412, so that the trailing edge of the bundle of sheets abuts against the sheet trailing edge hitting member 471 that is located at the projecting position described above. It is thus aligned and is discharged to the stack tray 421.

Because the rack 452 moves along the retreat of the sheet bundle discharging member 413, the pressing member 487 separates from the arm 486, so that the sheet trailing edge hitting member 471 turns to the evacuation position by its own weight. It is noted that although the rack 452 used for the sheet bundle discharging member 413 has been used in the above explanation, another lack driven by the motor 430 may be used instead.

Next, another modification for accommodating to a case when the sheet on the post-processing tray 410 is curled will be explained with reference to FIGS. 23 and 24.

A sheet discharging path 490, i.e., a path for discharging a sheet S received from the sheet receiving section 401 (see FIG. 2) to the post-processing tray 410, is provided above the post-processing tray 410 as shown in FIG. 23. The sheet discharging path 490 is composed of an upper guide 414 and a lower guide 414*a*.

The upper guide 414A extends further, thus forming a guide member 491. The guide member 491 is provided at the downstream side of the sheet conveying (discharging) direction of the trailing edge stopper 411 above the post-processing tray 410 and guides the sheet S to be pressed against the trailing edge stopper 411 by the offset roller 407 rotating in reverse after being discharged from the sheet discharging path 490 as described above to the trailing edge stopper 411 while restricting the sheet S from moving upward.

There is also provided a sheet isolating portion 411*a*, a catching member formed in a body with the trailing edge stopper 411 by bending the edge of the trailing edge stopper 411 in the direction of the offset roller 407, between an exit 490*a* of the sheet discharging path 490 and the trailing edge stopper 411 as shown in the figure.

Here, the sheet isolating portion 411*a* catches the trailing edge of the sheet S and restricts the trailing edge from moving up when the sheet S whose leading edge or trailing edge in the sheet conveying direction is curled as shown in the figure is pressed against the trailing edge stopper 411 by reversely rotating the offset roller 407 as described above.

The sheet isolating portion 411*a* is formed so that at least its edge is higher than a horizontal extension line (parallel to the post-processing tray 410) of the guide member 491 formed by extending as described above. Accordingly, the curled sheet guided by the guide member 491 is led to the sheet isolating portion 411*a*.

Since the sheet isolating portion 411*a* restricts the trailing edge of the sheet S from moving up as described above, the trailing edge of the sheet S will not protrude out to the exit 490*a* of the sheet discharging path 490. Thereby, it becomes possible to isolate the curled sheet S from the next sheet so as not to abut therewith and as a result, to stably align the sheet S.

Next, an operation for aligning a largely curled sheet S that is conveyed to the post-processing tray 410 will be explained.

Figure 23A:
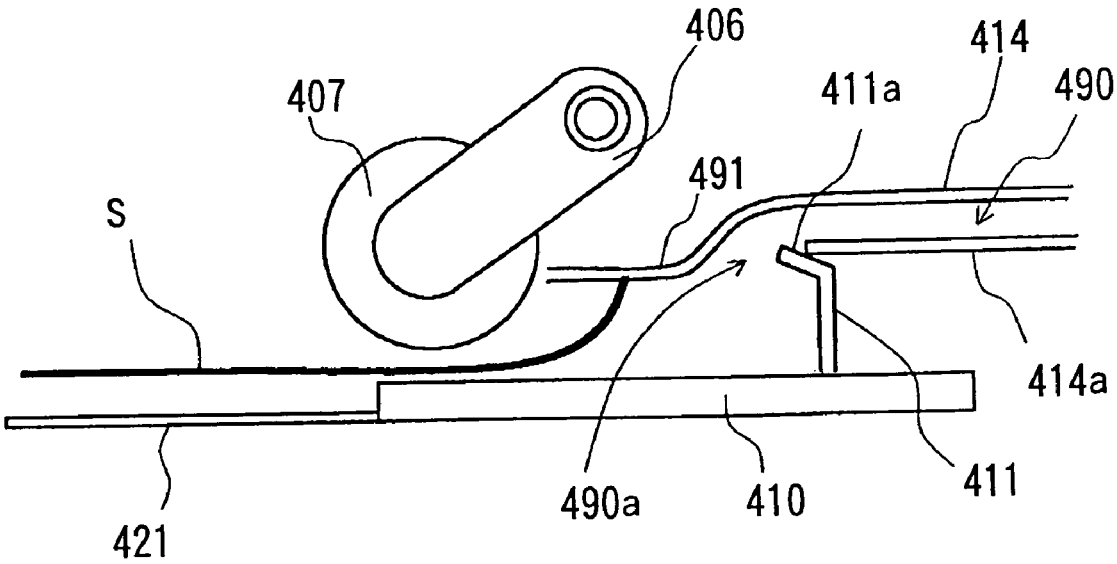

For instance, when the sheet whose leading or trailing edge is curled upward in the sheet conveying direction is discharged to the post-processing tray 410 and is conveyed by the offset roller 407 and when the offset roller 407 stops, the sheet S stops at the position as shown in FIG. 23A. Then, when the offset roller 407 is reversed, the sheet S is conveyed toward the trailing edge stopper 411.

Figure 23B:
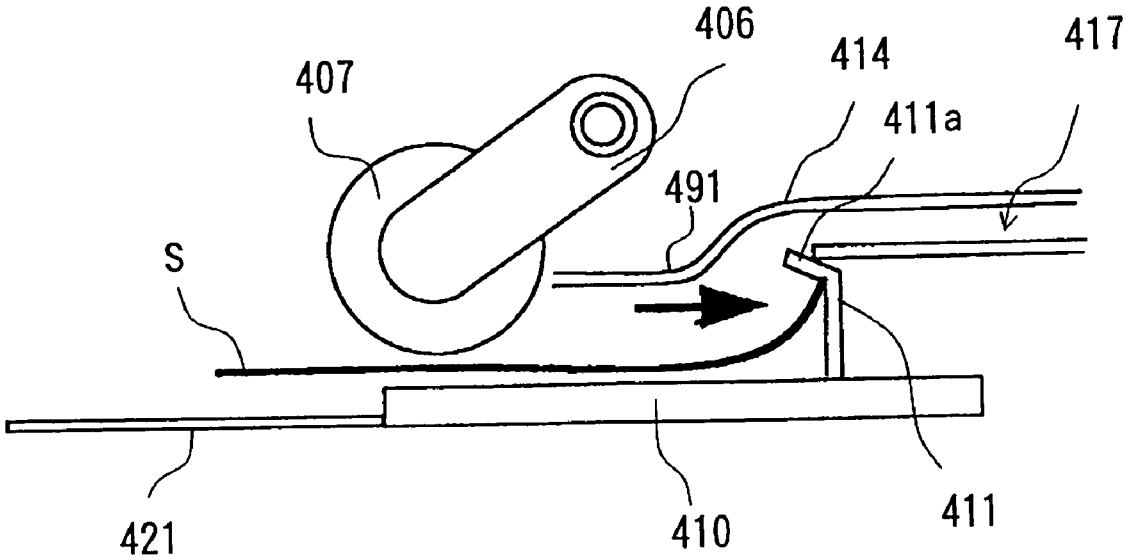

Here, the sheet S is conveyed toward the trailing edge stopper 411 in the state in which the curled trailing edge of the sheet S is pressed by the guide member 491, i.e., in the state in which the upward move thereof is restricted. Then, the sheet S whose upward move is restricted by the guide member 491 soon gets into the sheet isolating portion 411*a* of the trailing edge stopper 411. After that, when the sheet S abuts against the sheet isolating portion 411*a*, it moves along an inclination of the sheet isolating portion 411*a* and is aligned by hitting against the trailing edge stopper 411 as shown in FIG. 23B.

Although the trailing edge tries to move upward due to its curl after hitting against and being aligned by the trailing edge stopper 411 as described above, it will not protrude out to the exit 490*a* of the sheet discharging path 490 because it is caught by the sheet isolating portion 411*a*.

It is noted that the shape of the guide member 491, a gap with the post-processing tray 410 and the position of the edge of the sheet isolating portion 411*a* are set so that the trailing edge of the sheet S will not get into the gap between the guide member 491 and the sheet isolating portion 411*a*, i.e., the exit of the sheet discharging path 490, even if the curl of the sheet S is large at part where no restriction is given by the guide member 491. It is also possible to provide a flapper that permits a sheet to be discharged from the sheet discharging path 490 and that prevents the sheet from entering from the exit 490*a*. Thus, the trailing edge of the sheet S enters steadily under the sheet isolating portion 411*a* of the trailing edge stopper 411 without clogging the exit 490*a* of the sheet discharging path 490.

Figure 24A:
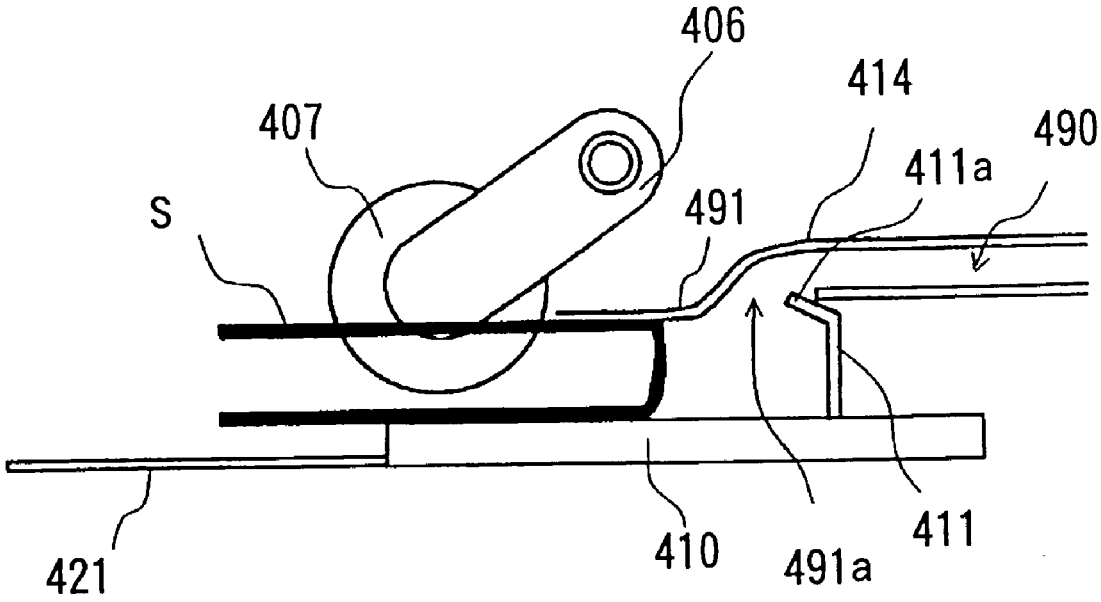

In case of a sheet S whose both edges in the width direction are curled on the other hand, the sheet S stops at the position indicated in FIG. 24A after being discharged to the post-processing tray 410 and conveyed by the offset roller 407 and when the offset roller 407 stops. That is, the both edges of the sheet S abut to the guide member 491 due to its curl.

Figure 24B:
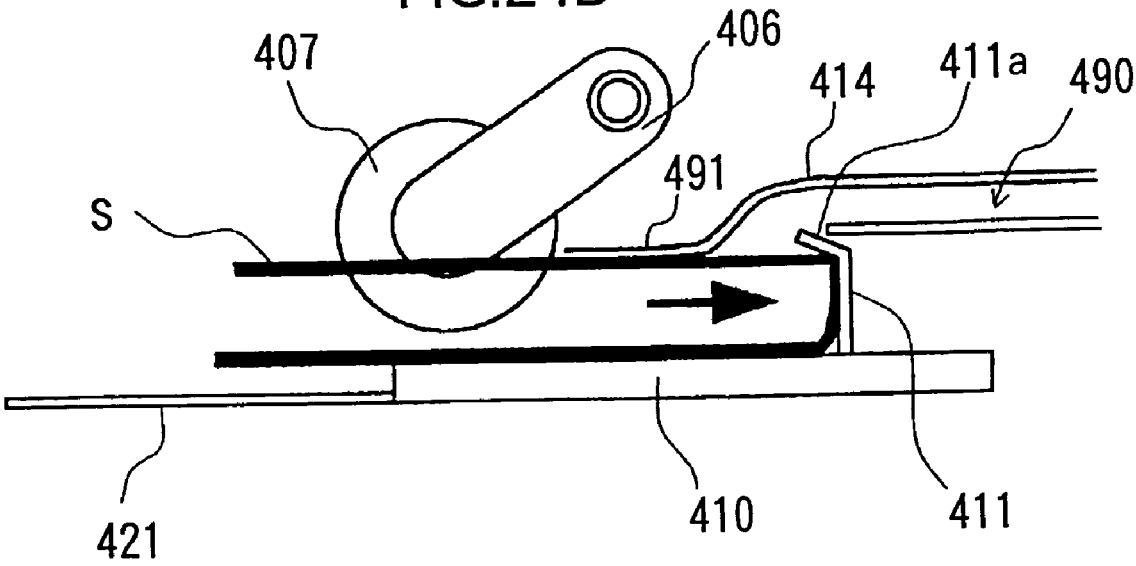

Then, the sheet S is conveyed toward the trailing edge stopper 411 by the offset roller 407 rotated in reverse in the state in which the leading edge of the curled sheet S is pressed by the guide member 491. It moves along the inclination of the sheet isolating portion 411*a* as it is and is aligned by hitting against the trailing edge stopper 411 as shown in FIG. 24B. It is noted that because the position of the trailing edge of the sheet S is regulated by the sheet isolating portion 411*a*, the trailing edge of the sheet S will not clog the discharging exit 490*a* of the sheet discharging path 490.

Since the sheet isolating portion 411*a* is provided between the trailing edge stopper 411 and the exit 490*a* of the sheet discharging path 490, the guide member 491 is provided on the downstream of the sheet conveying (discharging) direction of the trailing edge stopper 411 to guide the sheet S to the trailing edge stopper 411 while restricting the upward move of the sheet S and the sheet isolating portion 411*a* catches the sheet abutting against the trailing edge stopper 411, the sheet will not protrude out to the exit 490*a* of the sheet discharging path 490 and the sheet S having such large curl may be stably aligned with the mechanism simplified as described above.

It is noted that the same applies to a sheet S whose leading or trailing edge is curled downward or to a sheet S whose both edges in the width direction are curled downward.

Next, a still other modification of the inventive sheet post-processing unit, accommodating to a case when sheets to be aligned and bound by moving in the transverse direction and sheets not to be bound are mixed, will be explained with reference to FIGS. 25 through 29.

Figure 29:
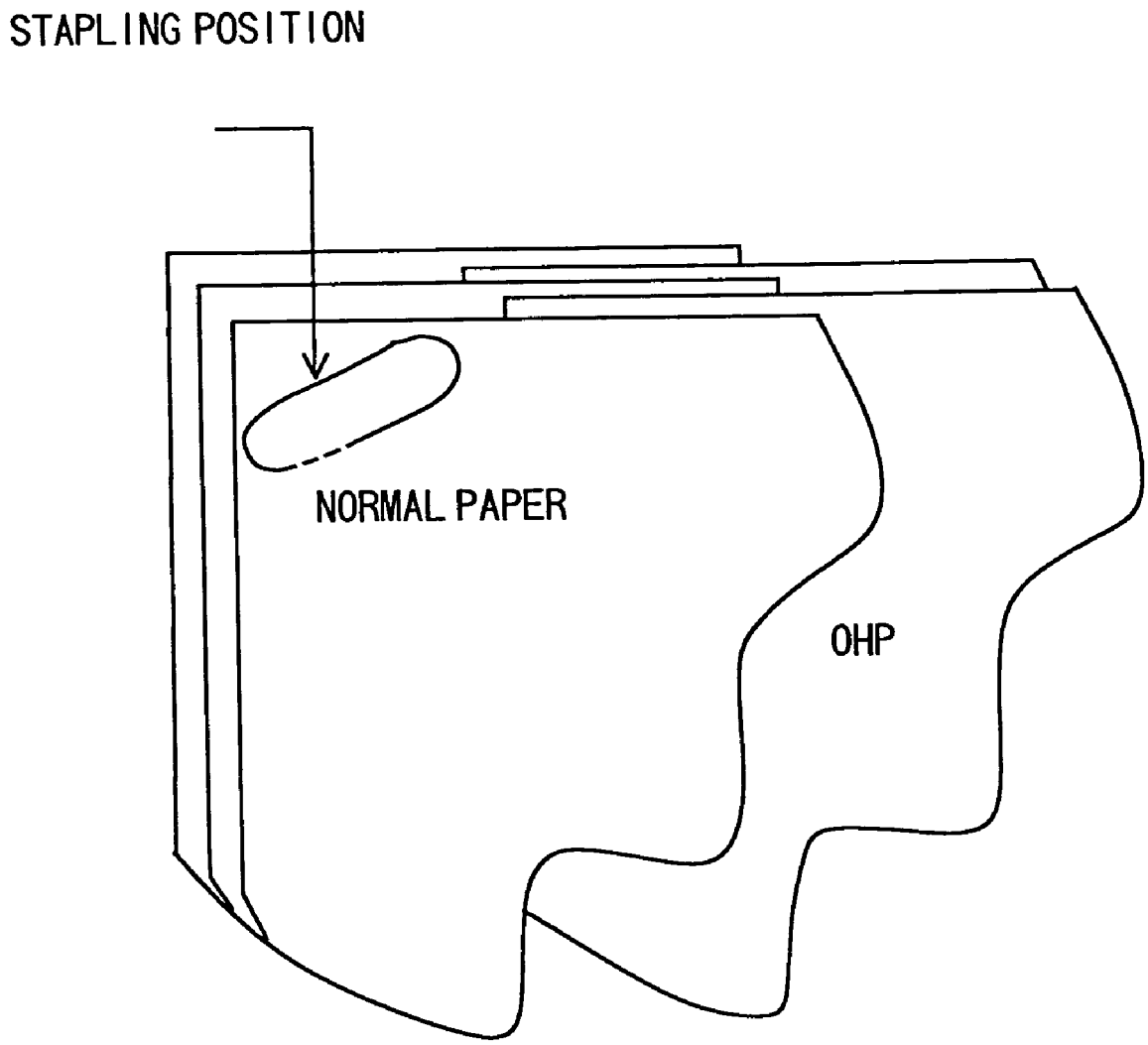
FIG. 29 is a plan view showing a state in which normal papers are stapled in a state in which the normal papers are mixed with OHP (over-head projector) sheets according to the still other modification of the sheet post-processing unit.
Figure 30:
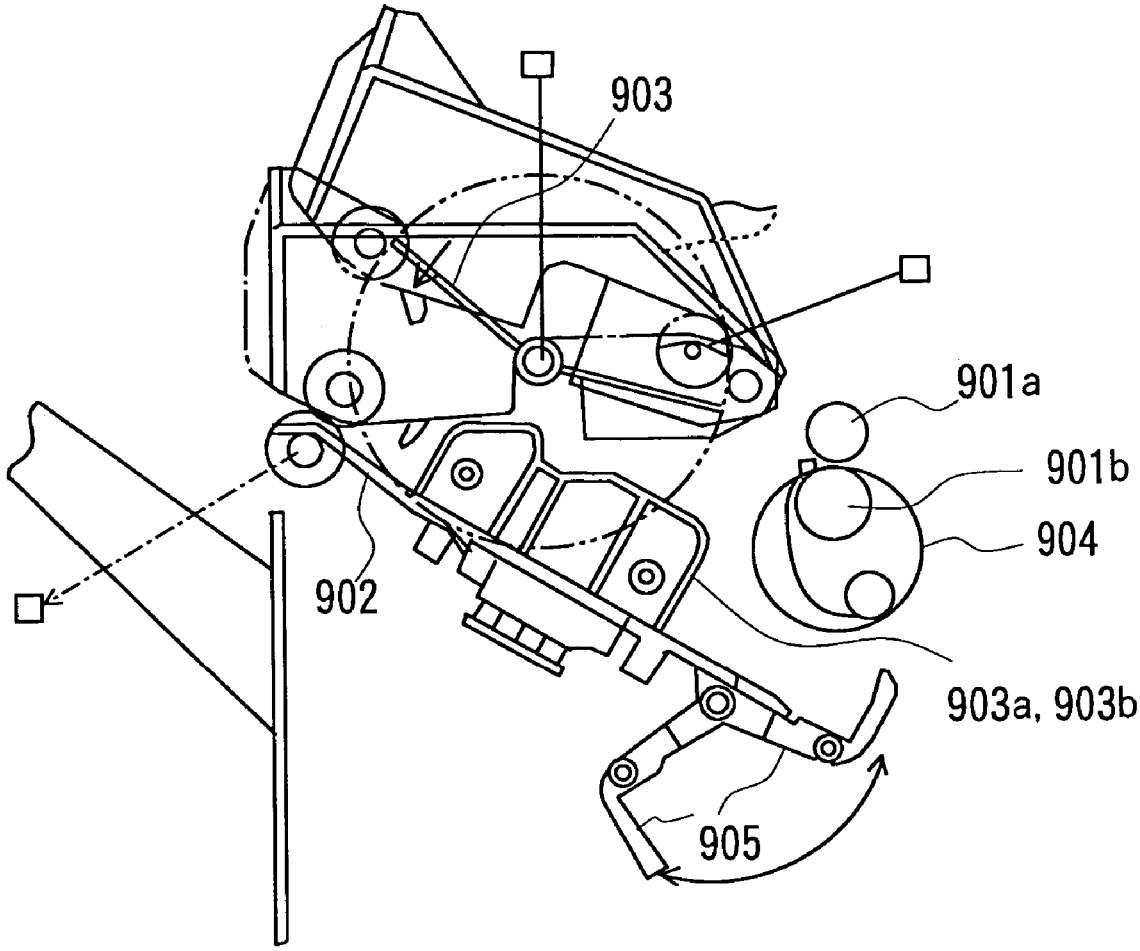
FIG. 30 is a schematic front view of a prior art sheet post-processing unit.

The sheet post-processing unit 400 of the invention is capable of binding a bundle of normal papers while interleaving OHP sheets (sheets for an over-head projector) not to be bound between the normal papers in binding the normal papers for example as shown in FIG. 29.

Figure 27:
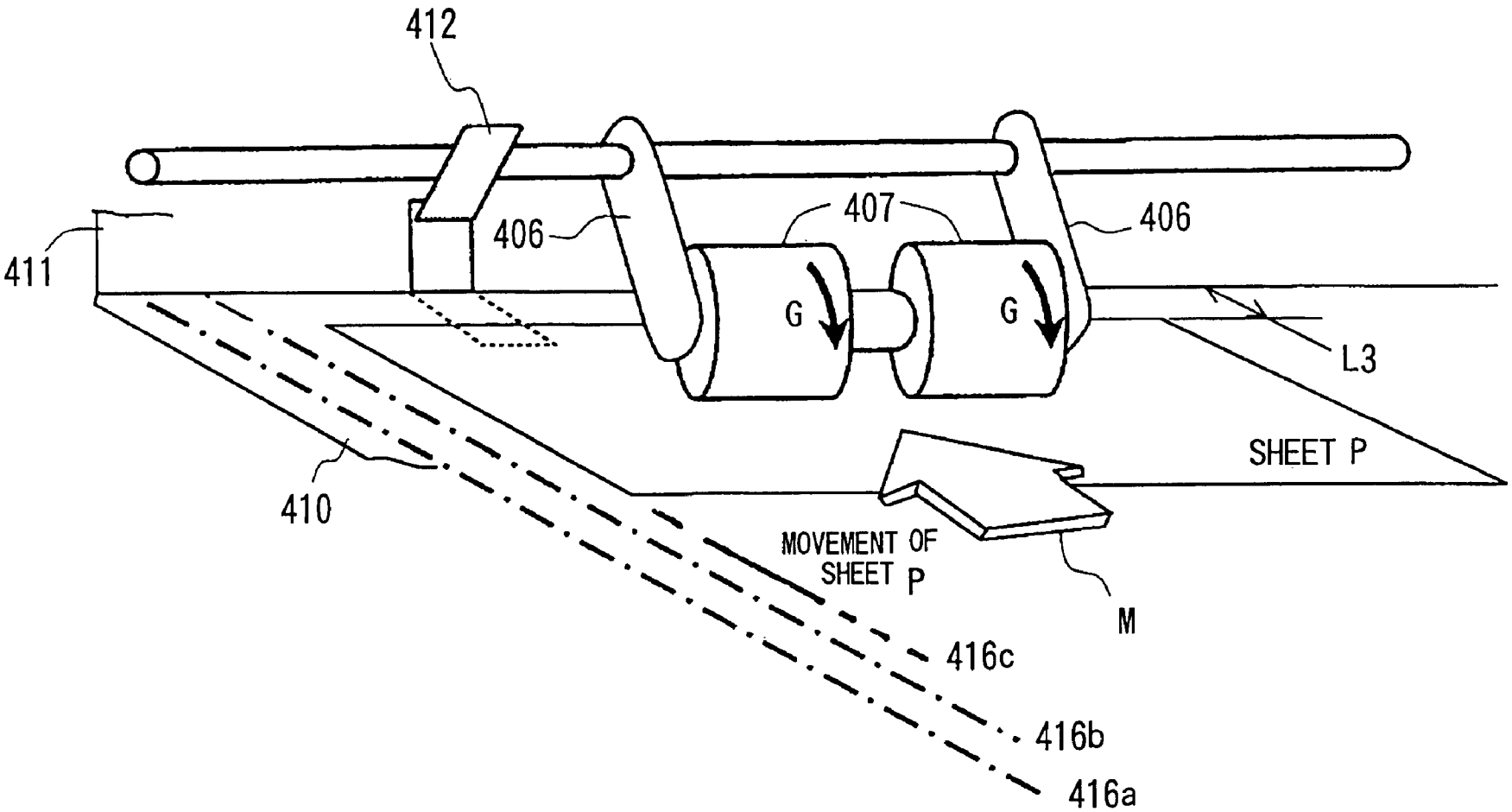
FIG. 27 is a perspective view showing a part of the operation of the still other modification of the inventive sheet post-processing unit.
Figure 28:
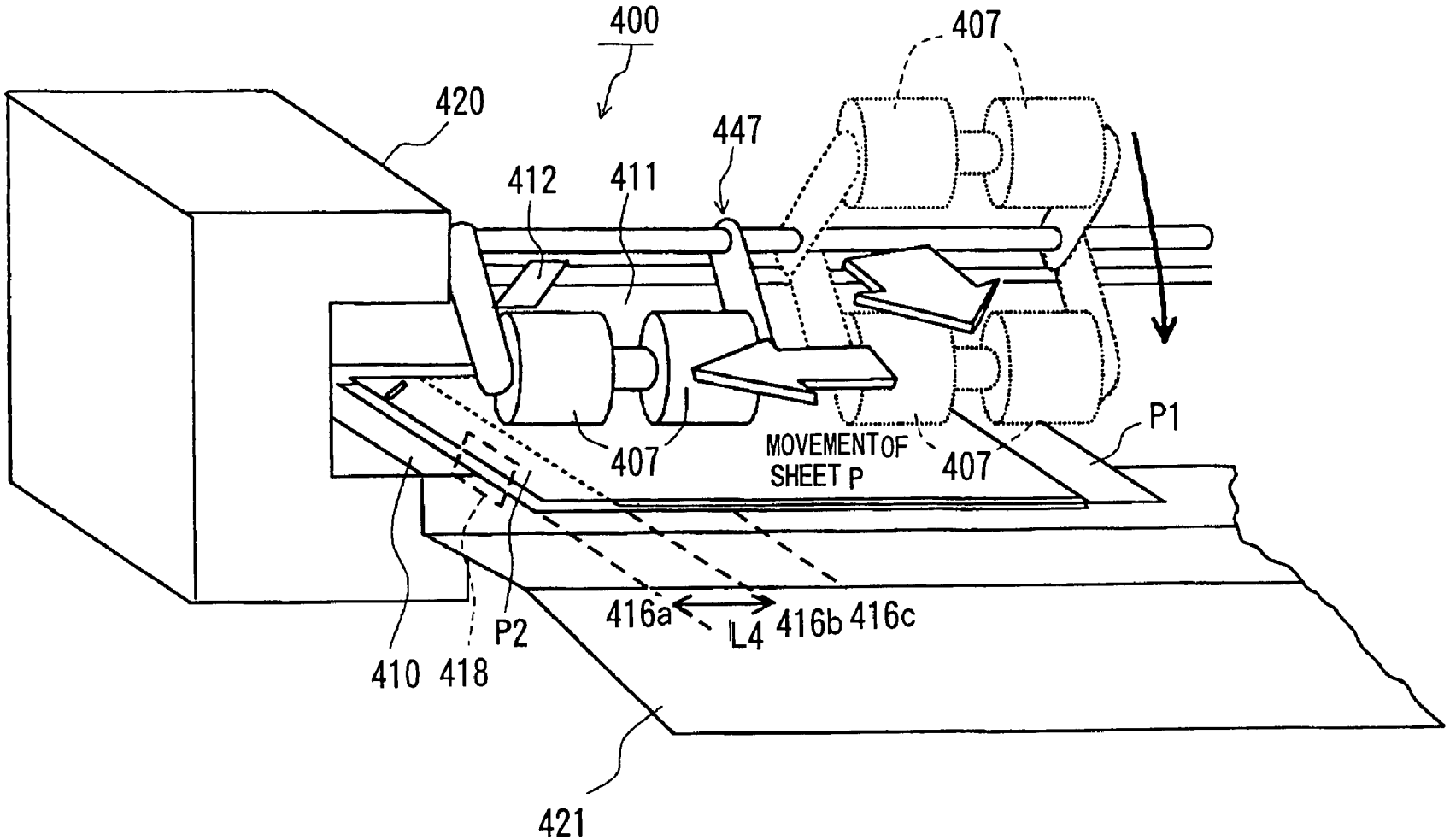
FIG. 28 is a perspective view of the still other modification of the sheet post-processing unit, showing a state in which sheets to be stapled and sheets not to be stapled are mixed on the sheet post-processing tray and a stapler unit has stapled the sheets.

It is noted that although a sheet not to be post-processed is stacked at the very position (denoted by a reference numeral 416*c*) where it is discharged, it is possible to arrange so as to stack it by moving to a position denoted by a reference numeral 416*b* between the reference numeral 416*c* and a reference numeral 416*a* as shown in FIGS. 27 and 28. In this case, a length L4 shown in FIG. 28 is shortened, so that a droop of the edge of the bundle of sheets to be processed which is positioned above sheets not to be processed may be reduced and a boundary between the sheets not to be processed and the sheets to be processed may be made clear.

Since the inventive sheet post-processing unit 400 is arranged so as to discharge the sheet not to be bound to the position 416*c* as it is and to move the sheet to be bound to the aligning position 416*a* for binding the sheets, it is capable of binding the sheets to be bound even if the sheets not to be bound are mixedly stacked on the post-processing tray 410 on the way of stacking a predetermined number of the sheets to be bound on the post-processing tray 410. Thus, it is capable of increasing the efficiency for processing the sheets.

Although the offset roller 407 is used as the member for moving the sheet on the post-processing tray 410 toward the trailing edge stopper and as the member for moving the sheets in the direction orthogonal to the conveying direction in the inventive sheet post-processing unit 400, it is possible to move the sheet by using not the roller but a member for moving the sheet in the sheet conveying direction and a member for moving the sheet in the direction orthogonal to the sheet conveying direction.

These operations will be explained with reference to flowcharts in FIGS. 25 and 26. When the main unit 500A of the copying machine 500 starts a copying job, the CPU 111 waits for a sheet discharging signal to come from the controller 501 of the copying machine 500 (S101). When the CPU 111 receives the sheet discharge signal from the controller 501 via the serial interface section 130, it drives the pickup solenoid 433 to turn the offset roller arm 406 in the direction of the arrow U and to raise the offset roller 407 (S111). Then, the CPU 111 rotates the conveyance motor 431 to rotate the conveying roller 405 and the offset roller 407 rotating in the conveying direction in synchronism with the conveying roller 405 in the direction of the arrow E so as to be able to convey the sheet in the same direction with the sheet conveying direction of the copying machine (S121). Thereby, the offset roller 407 rises and rotates while waiting for the sheet to come.

When the CPU 111 receives a sheet advance detection signal from the entrance sensor 403 that detects the trailing edge of the sheet (S131), it stops driving the pickup solenoid 433 to cause the offset roller 407 to drop by its own weight in the direction of the arrow D and to press the surface of the sheet (S141). While the offset roller 407 has been rotating in the direction of the arrow E, the conveyance motor 431 continuously rotates the offset roller 407 to convey the sheet in the direction of the arrow F, i.e., in the downstream direction. When the sheet is conveyed to a predetermined stop position where the sheet discharge sensor 415 detects the trailing edge of the sheet P (S151) the CPU 111 stops the conveyance motor 431 to stop the rotation of the offset roller 407 once and to stop the conveyance of the sheet in the direction of the arrow F (S152). Here, the CPU 111 judges whether or not a user has given an instruction to bind the sheet (S161).

When the user has given the instruction to bind the sheets, the sheets must be moved to the sheet aligning position 416*a* where the sheet is bound. Then, the CPU 111 starts the offset motor 432 to move the offset roller 407 in the direction of the arrow J from the position of the dotted line to the position of the solid line as shown in FIG. 13 (S171). When the offset roller 407 moves in the direction of the arrow J while in contact with the sheet P, the sheet P is also moved in the same direction by frictional force of the offset roller 407. The CPU 111 moves the sheet by a predetermined distance by the offset roller 407 and when the sheet arrives at the aligning position 416*a*, it stops the offset motor 432.

The positioning wall 416 for example is disposed as the side edge aligning means at the aligning position 416*a*. The move of the sheet P in the direction of the arrow J stops when the sheet P abuts against the positioning wall (sheet width edge aligning wall) 416 and bends more or less. That is, the extent of move of the sheet on the post-processing tray 410 moved by the offset roller 407 from the position 416*c* of the side edge of the sheet to the positioning wall 416 is set to be slightly longer than a distance L1 from the position 416*c* to the positioning wall 416. To that end, the CPU 111 continuously rotates the offset motor 432 until when the offset roller 407 finishes to move the sheet by the extent of move described above. It is noted that the extent of move of the sheet described above may be controlled by the CPU 111 based on a number of revolution of the offset motor 432 or may be controlled by stopping the rotation of the offset motor 432 after detecting the sheet by a sensor not shown disposed in the vicinity of the positioning wall 416.

Since the sheet hits against the positioning wall 416 and bends more or less, the sheet abuts steadily against the positioning wall 416 and its side edge is accurately positioned and aligned. It is noted that the bend of the sheet is on a level that will not separate the sheet from the positioning wall 416 by the resilience of the sheet when the offset roller 407 separates from the sheet and the sheet is released from the bend.

The CPU 111 opens the sheet clamping member (denoted as a gripper claw in the flowcharts) 412 of the sheet bundle discharging member (denoted as a clamping mechanism in the flowcharts) 413 standing by at its home position 413*a* by actuating the clamp solenoid 434 (S181). Then, the CPU 111 rotates the conveyance motor 431 in reverse to rotate the offset roller 407 in the direction of the arrow G which is the reverse direction from the sheet conveying direction (S191), to convey the sheet in the direction of the arrow M on the upstream side so that the upstream edge (trailing edge) of the sheet hits against the trailing edge-stopper 411 and to align the trailing edge (upstream edge) of the sheet (S201). The CPU 111 then stops the rotation of the offset roller 407 (S211).

The move of the sheet P in the direction of the arrow M stops when the sheet P abuts against the trailing edge stopper 411 and bends more or less. That is, the extent of move of the sheet moved by the offset roller 407 toward the upstream side from the position where the sheet has been aligned by the positioning wall 416 to the trailing edge stopper 411 is set to be slightly longer than a distance L2 from the upstream edge of the sheet abutting against the positioning wall 416 to the trailing edge stopper 411 (see FIG. 13). To that end, the CPU 111 continuously rotates the conveyance motor 431 until when the offset roller 407 finishes to move the sheet by the extent of move described above. It is noted that the extent of move of the sheet described above may be controlled by the CPU 111 based on a number of revolution of the conveyance motor 431 or may be controlled by stopping the rotation of the conveyance motor 431 after a predetermined period of time after detecting the sheet by a sensor not shown disposed in the vicinity of the trailing edge stopper 411.

Since the sheet hits against the trailing edge stopper 411 and bends more or less, the sheet abuts steadily against the trailing edge stopper 411 and its upstream edge is accurately positioned and aligned. It is noted that the bend of the sheet is on a level that will not separate the sheet from the trailing edge stopper 411 by the resilience of the sheet when the offset roller 407 separates from the sheet and the sheet is released from the bend.

The CPU 111 drives the pickup solenoid 433 to raise the offset roller 407 in the direction of the arrow U from the position of the dotted line to the position of the solid line as shown in FIG. 14 (S221). Then, the CPU 111 stops to drive the clamp solenoid 434 to close the sheet clamping member (gripper craw) 412 to hold the aligned sheet (S231). Note that the rotation of the offset roller 407 may be also stopped after raising it. The CPU 111 returns the raised offset rollers 407 to the initial position (offset home position) for supplying sheets by the offset motor 432 that rotates under the control of the CPU 111 through the intermediary of the pinion 439 and the rack 441 as shown in FIG. 14. The offset roller 407 returns to the offset home position because the rack supporting member 444 returns to the offset home position. The CPU 111 detects whether or not the rack supporting member 444 has returned to the initial position by the offset home position sensor 150. Based on the detection signal of the offset home position sensor 150, the CPU 111 stops the offset motor 432. Thus, the offset roller 407 returns to the home position (S241).

When the user has given no instruction to bind the sheet in Step 161 on the other hand, the CPU 111 opens the sheet clamping member (gripper craw) 412 of the sheet bundle discharging member (clamp mechanism) 413 as shown in FIG. 27 by driving the clamp solenoid 434 (S163). Then, the CPU 111 rotates the conveyance motor 431 in reverse to rotate the offset roller 407 in the direction of the arrow G which is the reverse direction from the sheet conveying direction (S164) to convey the sheet in reverse in the direction of the arrow M on the upstream side and to hit the trailing edge of the sheet against the trailing edge stopper 411 (S165).

The move of the sheet P in the direction of the arrow M stops when the sheet P abuts against the trailing edge stopper 411 and bends more or less also in this case. That is, the extent of move of the sheet moved by the offset roller 407 from the sheet discharge position where the sheet has been discharged to the post-processing tray 410 to the trailing edge stopper 411 is set to be slightly longer than a distance L3 from the upstream edge of the discharged sheet to the trailing edge stopper 411. To that end, the CPU 111 continuously rotates the conveyance motor 431 until when the offset roller 407 finishes to move the sheet by the extent of move described above. It is noted that the extent of move of the sheet described above may be controlled by the CPU 111 based on a number of revolution of the conveyance motor 431 or may be controlled by stopping the rotation of the conveyance motor 431 after a predetermined period of time after detecting the sheet by a sensor not shown disposed in the vicinity of the trailing edge stopper 411.

Since the sheet hits against the trailing edge stopper 411 and bends more or less, the sheet abuts steadily against the trailing edge stopper 411 and its upstream edge is accurately positioned and aligned. It is noted that the bend of the sheet is on a level that will not separate the sheet from the trailing edge stopper 411 by the resilience of the sheet when the offset roller 407 separates from the sheet and the sheet is released from the bend.

The CPU 111 drives the pickup solenoid 433 to stop and raise the offset roller 407 (S166, S167) and stops to drive the clamp solenoid 434 to close the sheet clamping member (gripper craw) 412 to hold the aligned sheet (S168). Thereby, the sheet previously discharged will not follow a succeeding sheet sent from the post-processing tray 410 and conveyed in the sheet conveying direction. Note that the rotation of the offset roller 407 may be stopped after raising it.

Then, the CPU 111 judges whether or not the sheet is the final page based on data sent from the main unit 500A of the copying machine 500 (S281). When the CPU 111 judges that it is not the final page, it receives a next sheet discharge signal sent from the controller 501 of the copying machine 500 (S291), returns to Step 121 and repeats the aforementioned flow until when the sheet of the final page is stored in the post-processing tray 410.

It is noted that in the flow of sheet binding process, the sheet clamping member (gripper craw) 412 which has been closed in Step 231 is kept closed until when the sheet is moved to the aligning position 416*a* in Step 171, so that the preceding sheet already stacked on the post-processing tray 410 will not follow the succeeding sheet laid upon the preceding sheet and moved to the sheet aligning position 416*a*. That is, in the processes in Steps 121 and 171, the sheet clamping member (gripper craw) 412 holds the preceding sheet to prevent the preceding sheet from following the succeeding sheet.

Further, even in case when a sheet to be bound is sent on a sheet not to be bound, the sheet to be bound is moved in offset in Step 171 in the state in which the sheet not to be bound is held by the sheet clamping member (gripper craw) 412 in Step 168, so that the sheet not to be bound is kept at the position 416*c* without following the sheet to be bound even when the sheet to be bound is moved transversely by the offset roller 407. While the sheet to be bound is conveyed in reverse toward the trailing edge stopper 411 in this state, the sheet not to be bound is kept at the position 416*c* even when the sheet clamping member (gripper craw) 412 is opened at this time (S181).

By repeating this flow, the sheet post-processing unit 400 discharges the sheet at the position 416*c* on the post-processing tray 410 as it is every time when sheets are discharged from the main unit 500A of the copying machine 500 or recognizes the sheet size and aligns the sheet at the sheet aligning position 416*a* which is the offset position suitable for the sheet binding process. As a result, a sheet P1 stacked at the position 416*c* to which the sheet has been discharged and a sheet P2 moved to the aligning position 416*a* for stapling are mixedly stacked on the post-processing tray 410.

When it is judged to be the final page in Step 281, i.e., when a bundle of sheets corresponding to copied documents is stacked on the post-processing tray 410, the CPU 111 checks whether or not the stapling process is being selected (S301). When the stapling process is been selected, the CPU 111 drives the stapler unit 420 to execute the stapling process on the bundle of sheets as shown in FIG. 28 (S311).

After completing the stapling process, or when the stapling process is not being selected, the CPU 111 controls the sheet bundle discharging motor 430 to move the sheet bundle discharging member (clamping mechanism) 413 clamping the bundle of sheets in the direction of the stack tray 421 to the bundle discharging position 413*b* from the home position 413*a* and opens the sheet clamping member (gripper craw) 412 (S321). Then, the CPU 111 controls the stack tray elevating motor 135 to lower the stack tray 421 by a distance almost equal to the thickness of the bundle of sheets and opens the sheet clamping member (gripper craw) 412 (S331). The CPU 111 also reverses the rotation of the sheet bundle discharging motor 430 to return the sheet bundle discharging member (clamping mechanism) 413 to its home position 413*a* and closes the sheet clamping member (gripper craw) 412. Then, the CPU 111 stops the conveyance motor 431 to stop the rotation of the conveying roller 405 and the offset roller 407 (S351) and lowers the offset roller 407 (S361). The CPU 111 thus ends the series of processes.

As described above, because the inventive sheet post-processing unit is arranged so that the sheet bundle discharging member (clamping mechanism) 413 holds the sheet stacked on the post-processing tray 410 in either cases of moving the sheet to the trailing edge stopper 411 and to the positioning wall 416, the sheet precedently stacked will not follow a succeeding sheet that is being moved by the offset roller 407. It is thus possible to prevent disturbance of the aligned sheets.

Still more, because the inventive sheet post-processing unit 400 is arranged so as to convey the sheet selectively to the upstream and downstream sides of the sheet conveying direction and to the positioning wall 416 by the offset roller 407 which is contactable with the sheet, it is able to align the stacked sheets without causing ruggedness.

It is noted that when the post-processing of punching holes through the bundle of sheets is to be carried out, the inventive sheet post-processing unit can punch accurately at intended positions because it can punch without disturbing the bundle of sheets.

It will be obvious to those having skill in the art that many changes may be made in the above-described details of the preferred embodiment of the invention and the modifications thereof. The scope of the invention, therefore, should be determined by the following claims.

What is claimed is:

1. A sheet post-processing unit, comprising:

sheet stacking means for sequentially stacking sheets discharged one after another;

sheet conveying means including at least one roller rotatably supported by an arm movably supported along an axis and rockably supported in up and down directions, and an actuator for moving said arm in the up and down directions, said sheet conveying means being capable of selectively conveying a sheet to be discharged in one of the downstream and upstream directions of a sheet discharging direction and being capable of moving up and down to be contactable with and detachable from the sheet;

an upstream edge regulating member for aligning a sheet stacked on said sheet stacking means by hitting against an upstream edge of the sheet;

intersectional moving means for moving said arm of said sheet conveying means along the axis in a direction intersecting with the sheet discharging direction; and an intersectional regulating member for aligning the sheet by hitting against an edge of the sheet on a side intersecting with the sheet discharging direction, wherein said roller of said sheet conveying means aligns the sheet by contacting with an uppermost sheet of the sheets stacked on said sheet stacking means and by moving the sheet in the direction intersecting with the sheet discharging direction by said intersectional moving means to hit the uppermost sheet against said upstream edge regulating member and said intersectional regulating member, and wherein said stacking means is a first sheet stacking means:

second sheet stacking means, disposed in a vicinity of said first sheet stacking means and movable in a vertical direction for stacking the sheets; and transfer means for clamping and transferring the sheets stacked on said first sheet stacking means to said second sheet stacking means.

2. The sheet post-processing unit as set forth in claim 1, further comprising post-processing means for post-processing the sheets aligned by said upstream edge regulating member and said intersectional regulating member.

3. The sheet post-processing unit as set forth in claim 1, wherein said sheet conveying means includes a roller that contacts with and conveys the uppermost sheet among the sheets stacked on said sheet stacking means and that is moved in the direction intersecting with the sheet discharging direction by said intersectional moving means to align the uppermost sheet by hitting the uppermost sheet against said upstream edge regulating member and against said intersectional regulating member.

4. The sheet post-processing unit as set forth in claim 1, further comprising:

a control section for controlling the conveyance of said sheet conveying means or a movement of said conveying means so that each conveyance of the uppermost sheet of said sheet conveying means or movement thereof of said intersectional moving means, that aligns the sheets by hitting an edge of the uppermost sheet against said upstream edge regulating member or said intersectional regulating member is larger than a distance to said upstream edge regulating member or said intersectional regulating member that corresponds to the hitting edge of the uppermost sheet and so that said sheet roller slides on the uppermost sheet after hitting the uppermost sheet against said upstream edge regulating member or said intersectional regulating member.

5. The sheet post-processing unit as set forth in claim 1, further comprising:

a clamping member for clamping the sheet to prevent the sheet from following a moving succeeding sheet when the succeeding sheet is stacked on a preceding sheet stacked on said sheet stacking means and is conveyed or transferred by said sheet conveying means.

6. The sheet post-processing unit as set forth in claim 1, wherein said sheet stacking means includes a tray, wherein said sheet conveying means includes rollers provided so as to be contactable/separable with/from the sheet stacked on said tray and rotated in a normal or a reverse direction, and wherein said intersectional moving means includes a reciprocal driving device for moving said rollers in the direction intersecting with the sheet discharging direction.

7. The sheet post-processing unit as set forth in claim 1, wherein an outer periphery of said rollers is made of rubber or an elastic member similar to rubber such as a foam member.

8. The sheet post-processing unit as set forth in claim 1, further comprising an actuator for moving said rollers up and down with respect to said sheet stacking means.

9. The sheet post-processing unit as set forth in claim 1, further comprising:

sheet bundle pressing means for pressing the sheets stacked on said second sheet stacking means from the top; and pressing position moving means for selectively moving said sheet bundle pressing means to a pressing position for pressing the sheets from the top and to an evacuation position under said first sheet stacking means, wherein said transfer means includes a sheet bundle discharging means for discharging a bundle of sheets on said first sheet stacking means to said second sheet stacking means, and wherein said pressing position moving means moves said sheet bundle pressing means to the pressing position after finishing a sheet bundle discharging operation.

10. The sheet post-processing unit as set forth in claim 9, wherein said pressing position moving means moves said sheet bundle pressing means to the evacuation position in linkage with a movement of said sheet bundle discharging means in a sheet bundle discharging direction.

11. The sheet post-processing unit as set forth in claim 9, wherein said pressing position moving means includes a cam that turns along with a movement of said sheet bundle discharging means.

12. The sheet post-processing unit as set forth in claim 9, wherein said sheet bundle discharging means includes sheet bundle clamping means for clamping the bundle of sheets on said first sheet stacking means and said sheet bundle clamping means releases the bundle of sheets after said sheet bundle discharging means arrives at a position for discharging the bundle of sheets.

13. The sheet post-processing unit as set forth in claim 9, further comprising:

a sheet bundle trailing edge hitting member, provided so as to be able to go in and out at an end portion of said first sheet stacking means on a side of said second sheet stacking means, for hitting against a trailing edge of the bundle of sheets; and hitting member moving means for moving and projecting out said sheet bundle trailing edge hitting member from an end portion of said first sheet stacking means on the side of said second sheet stacking means, wherein said transfer means includes said sheet bundle discharging means for clamping and discharging the bundle of sheets on said first sheet stacking means to said second sheet stacking means, wherein said sheet bundle discharging means releases the bundle of sheets after moving to a position for discharging the bundle of sheets, and wherein said hitting member moving means projects out said sheet bundle trailing edge hitting member on an upstream side of said sheet bundle discharging means when said sheet bundle discharging means arrives at a position for discharging the bundle of sheets so that the trailing edge of the bundle of sheets which has been released from said sheet bundle discharging means hits against said sheet bundle trailing edge hitting member when said sheet bundle discharging means returns to a pre-movement position.

14. The sheet post-processing unit as set forth in claim 13, wherein said hitting member moving means includes a solenoid.

15. The sheet post-processing unit as set forth in claim 13, wherein said hitting member moving means includes a pressing member which moves in linkage with a movement of said sheet bundle discharging means and presses said sheet bundle trailing edge hitting member in a projecting direction.

16. The sheet post-processing unit as set forth in claim 1, wherein said stacking means is a first stacking means, a discharging path provided above said first sheet stacking means for conveying the sheets to said first sheet stacking means one after another;

a catching member, provided between said upstream edge regulating member and an exit of said discharging path, for catching the sheet so that the sheet that has been conveyed by said sheet conveying means to an upstream side of the sheet discharging direction and that has hit against said upstream edge regulating member will not project out to an exit of said discharging path; and a guide member, provided above said first sheet stacking means and downstream of the sheet discharging direction of said upstream edge regulating member, for guiding the sheet to be conveyed to the upstream side of the sheet discharging direction to said upstream edge regulating member, wherein said guide member guides the sheet to said upstream edge regulating member while restricting the sheet from moving up.

17. The sheet post-processing unit as set forth in claim 16, wherein said catching member is formed so as to direct the sheet to said upstream edge regulating member when the sheet guided by said guide member abuts thereto.

18. The sheet post-processing unit as set forth in claim 17, wherein said catching member is formed by bending an upper edge portion of said upstream edge regulating member.

19. The sheet post-processing unit as set forth in claim 16, wherein said guide member is formed by extending an upper guide constituting an upper face of said discharging path to the downstream side of said upstream edge regulating member.

20. The sheet post-processing unit as set forth in claim 1, further comprising a control section for selectively executing an operation of said sheet conveying means of hitting the sheet discharged to said first sheet stacking means against said upstream edge regulating member and an operation of hitting the sheet against said upstream edge regulating member after moving said arm of said sheet conveying means in the direction intersecting with the sheet discharging direction by said intersectional moving means.

21. An image forming apparatus, comprising:

image forming means for forming images; and the sheet post-processing unit as set forth in claim 1 for post-processing sheets on which images have been formed by said image forming means.

22. The image forming apparatus as set forth in claim 21, wherein the said sheet stacking means is a first stacking means, clamping means for clamping a preceding sheet or sheets to prevent the sheet or sheets from following a moving succeeding sheet when the succeeding sheet is stacked on the preceding sheet or sheets stacked on said first sheet stacking means and is conveyed by said sheet conveying means;

second sheet stacking means, disposed in a vicinity of said first sheet stacking means and movable in a vertical direction, for stacking the sheets;

transfer means for clamping and transferring the sheets stacked on said first sheet stacking means to said second sheet stacking means; and a control section for moving said second sheet stacking means so that a height of the upper face of an uppermost sheet transferred to said second sheet stacking means becomes substantially equal to a level of a stacking face of said first sheet stacking means after transferring the sheets to said second sheet stacking means by controlling said transfer means.

23. The image forming apparatus as set forth in claim 21, further comprising:

sheet bundle pressing means for pressing the sheets stacked on said second sheet stacking means from the top; and moving means for selectively moving said sheet bundle pressing means to a pressing position for pressing the sheets from the top and to an evacuation position under said first sheet stacking means, wherein said moving means moves said sheet bundle pressing means to the pressing position after finishing a sheet bundle discharging operation of said transfer means.

24. The image forming apparatus as set forth in claim 21, wherein said sheet stacking means is a first sheet stacking means, second sheet stacking means disposed in a vicinity of said first sheet stacking means and movable in a vertical direction, for stacking the sheets;

sheet bundle discharging means for clamping and moving a bundle of sheets on said first sheet stacking means toward said second sheet stacking means to discharge the bundle of sheets onto said second sheet stacking means;

a sheet bundle trailing edge hitting member, provided so as to be able to go in and out at the end of said first sheet stacking means on a side of said second sheet stacking means, for hitting against the trailing edge of the bundle of sheets;

hitting member moving means for moving and projecting said sheet bundle trailing edge hitting member from an end of said first sheet stacking means on the side of said second sheet stacking means; and a control section for controlling said sheet bundle discharging means so as to release the bundle of sheets after moving to a position for discharging the bundle of sheets and for controlling said hitting member moving means so as to project said sheet bundle trailing edge hitting member on an upstream side of said sheet bundle discharging means after said sheet bundle discharging means has moved to the position for discharging the bundle of sheets so that the trailing edge of the bundle of sheets released from said sheet bundle discharging means hits against said sheet bundle trailing edge hitting member when said sheet bundle discharging means returns to a pre-movement position.

25. The image forming apparatus as set forth in claim 21, further comprising:

a discharging path, provided above said first sheet stacking means, for conveying the sheets to said sheet stacking means one after another;

a catching member, provided between said upstream edge regulating member and an exit of said discharging path, for catching the sheet so that the sheet which has hit against said upstream edge regulating member will not project out to the exit of said discharging path; and a guide member, provided above said first sheet stacking means and downstream of the sheet discharging direction of said upstream edge regulating member, for guiding the sheet to be conveyed to an upstream side of the sheet discharging direction to said upstream edge regulating member.

26. A sheet post-processing unit, comprising:

first sheet stacking means for sequentially stacking sheets discharged one after another;

sheet conveying means including at least one roller rotatably supported by an arm movably supported along an axis and rotatably supported in up and down directions and an actuator for moving said arm in the up and down directions, said sheet conveying means being capable of selectively conveying the sheet to be discharged to said first sheet stacking means in one of the downstream and upstream directions of a sheet discharging direction and being capable of moving up and down to be contactable with and detachable from the sheet;

an upstream edge regulating member for aligning the sheet stacked on said first sheet stacking means by hitting against an upstream edge of the sheet;

intersectional moving means for moving said arm of said sheet conveying means along the axis in a direction intersecting with the sheet discharging direction;

an intersectional regulating member for aligning the sheet by hitting against a side of a sheet on a side intersecting with the sheet discharging direction;

post-processing means for post-processing the sheets aligned by said upstream edge regulating member and said intersectional edge regulating member;

second sheet stacking means for stacking the sheets disposed in a vicinity of said first sheet stacking means and movable in a vertical direction for stacking the sheets; and transfer means for clamping and transferring the sheets stacked on said first sheet stacking means to said second sheet stacking means, wherein said roller of said sheet conveying means aligns the sheet by contacting with the uppermost sheet of the sheets stacked on said first sheet stacking means and by moving the uppermost sheet in a direction intersecting with the sheet discharging direction by said intersectional moving means to hit the uppermost sheet against said upstream side regulating member and said intersectional regulating member, wherein said post-processing means includes a stapling device for binding an aligned bundle of sheets, wherein said second sheet stacking means includes a tray, and wherein said transfer means includes a sheet bundle discharging member for discharging a bound bundle of sheets to said tray.

* * * * *

UNITED STATES PATENT AND TRADEMARK OFFICE

CERTIFICATE OF CORRECTION

PATENT NO. : 7,392,983 B2
APPLICATION NO. : 10/940758
DATED : July 1, 2008
INVENTOR(S) : Takehiko Kodama et al.

It is certified that error appears in the above-identified patent and that said Letters Patent is hereby corrected as shown below:

DRAWING SHEET 8

FIG. 8, Step S140, "FROMING" should read --FORMING--; and
Step S160, "PREDETERMIED" should read --PREDETERMINED--.

DRAWING SHEET 25

Figure 25:
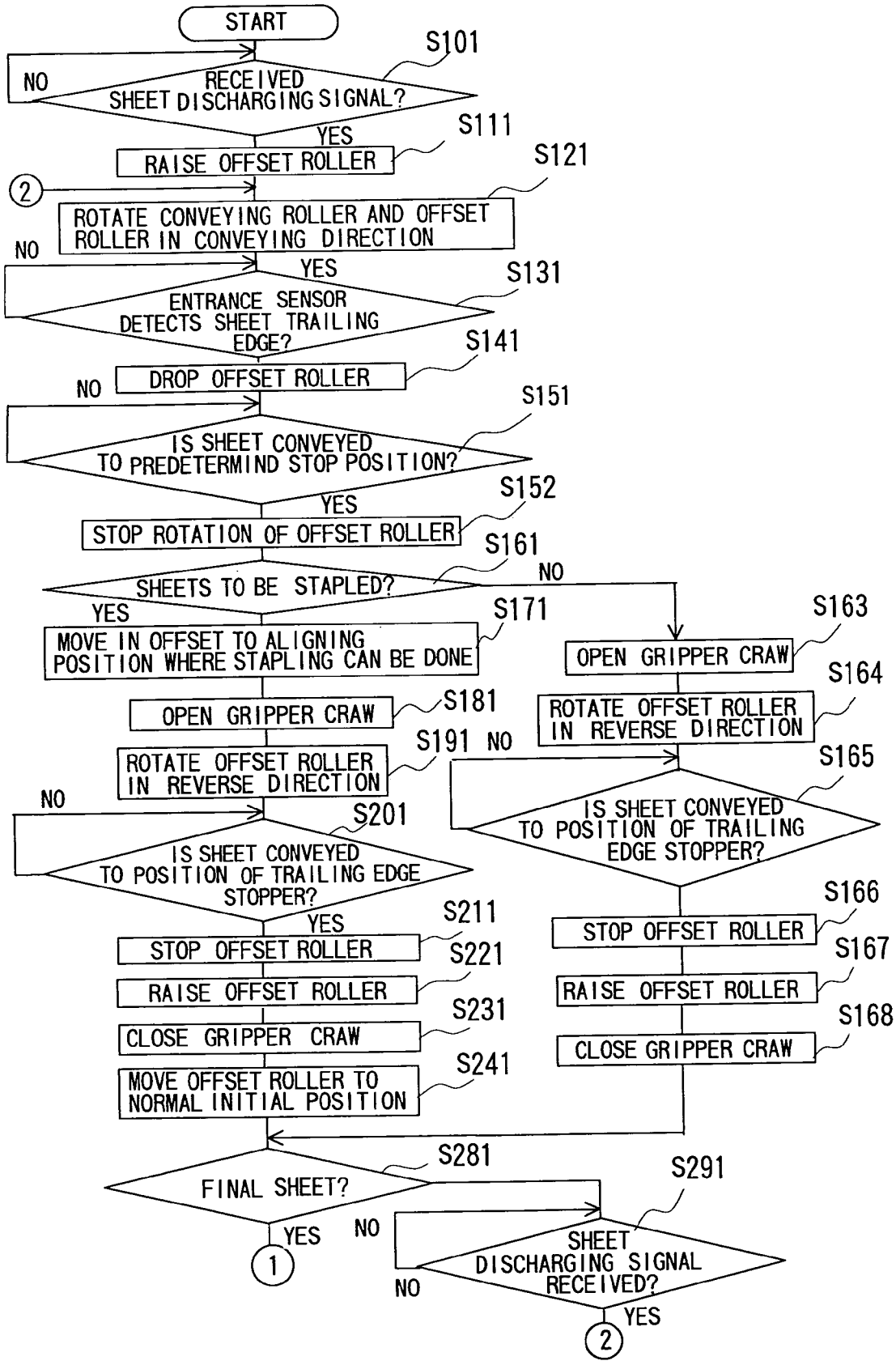
FIG. 25 is a part of a flowchart explaining an operation of a still other modification of the inventive sheet post-processing unit, which permits to mixedly convey a sheet that is to be aligned in the direction intersecting with the sheet conveying direction and a sheet that is not to be aligned.
Figure 26:
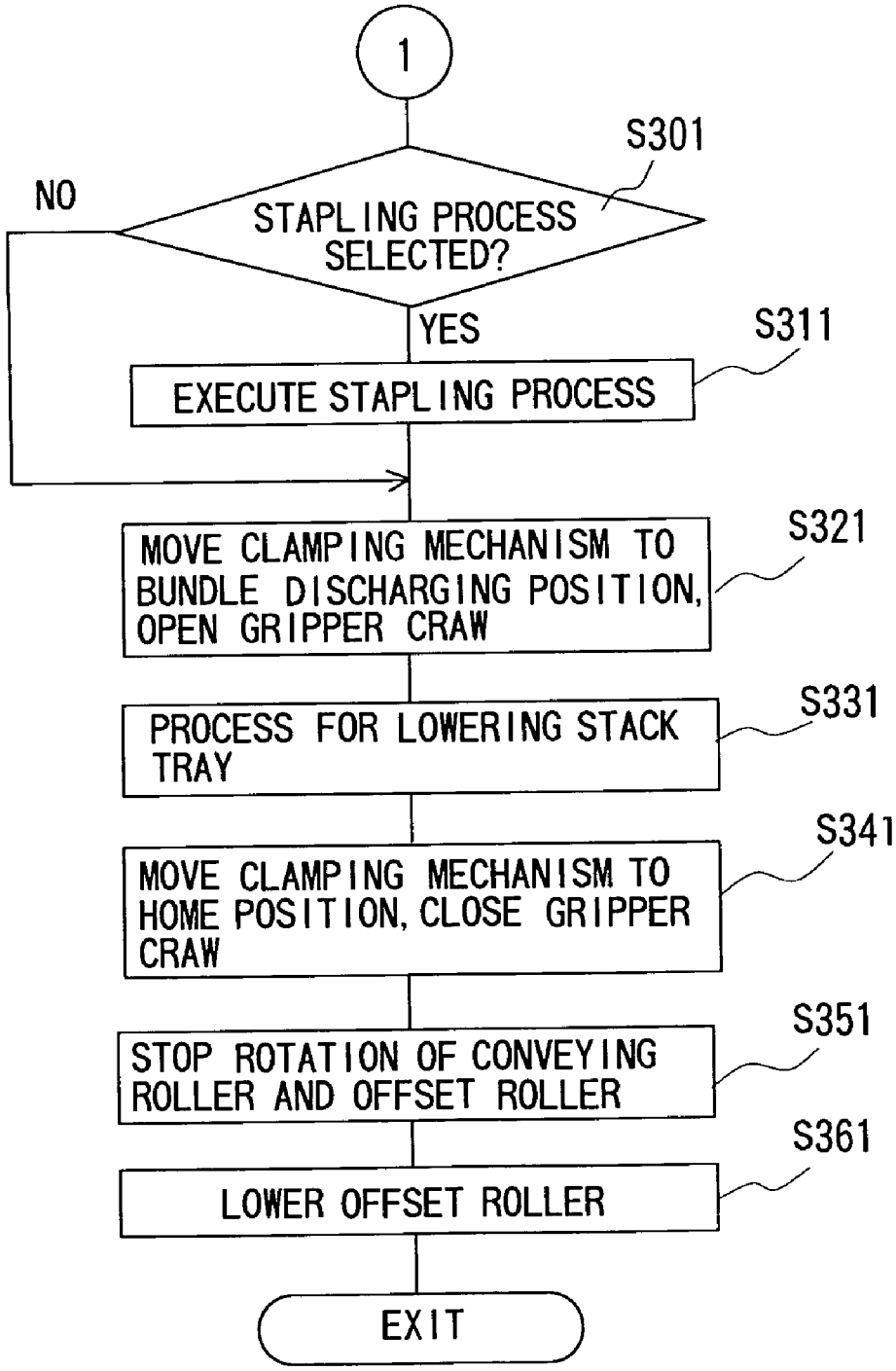
FIG. 26 is a flowchart continued from the flowchart in FIG. 25.

FIG. 25, Step S151, "PREDETERMIND" should read --PREDETERMINED--.

COLUMN 1

Line 17, "jobs" should read --job--.

COLUMN 5

Line 10, "attained" should read --attain--.

COLUMN 8

Line 15, "The," should read --The--.

COLUMN 10

Line 45, "or" should read --or move--.

COLUMN 16

Line 41, "421,as" should read --421 as--.

COLUMN 19

Line 12, "lack" should read --rack--.

COLUMN 22

Line 46, "edge-stopper" should read --edge stopper--.

UNITED STATES PATENT AND TRADEMARK OFFICE

CERTIFICATE OF CORRECTION

PATENT NO. : 7,392,983 B2
APPLICATION NO. : 10/940758
DATED : July 1, 2008
INVENTOR(S) : Takehiko Kodama et al.

It is certified that error appears in the above-identified patent and that said Letters Patent is hereby corrected as shown below:

COLUMN 24

Line 50, “is” should read --has--.

COLUMN 25

Line 61, “means:” should read --means;--.

Signed and Sealed this

Thirteenth Day of January, 2009

JON W. DUDAS
*Director of the United States Patent and Trademark Office*